US007328740B2

(12) United States Patent
Leeson et al.

(10) Patent No.: US 7,328,740 B2
(45) Date of Patent: Feb. 12, 2008

(54) HEAT EXCHANGER WITH BEVELED HEADER

(75) Inventors: Jeffrey S. Leeson, South Euclid, OH (US); Eric K. Peoples, Ravenna, OH (US); Michael W. Brakey, Shaker Heights, OH (US)

(73) Assignee: Duramax Marine, LLC, Hiram, OH (US)

( * ) Notice: Subject to any disclaimer, the term of this patent is extended or adjusted under 35 U.S.C. 154(b) by 0 days.

(21) Appl. No.: 11/434,622

(22) Filed: May 15, 2006

(65) Prior Publication Data

US 2006/0201652 A1 Sep. 14, 2006

Related U.S. Application Data

(63) Continuation of application No. 10/119,412, filed on Apr. 9, 2002, now Pat. No. 7,044,194, which is a continuation-in-part of application No. 09/427,565, filed on Oct. 26, 1999, now abandoned.

(51) Int. Cl.

| | |
|---|---|
| ***B63H 21/10*** | (2006.01) |
| ***B63H 21/38*** | (2006.01) |
| ***F28F 9/06*** | (2006.01) |
| ***F28F 21/06*** | (2006.01) |

(52) U.S. Cl. ..... 165/44; 165/41; 165/176; 440/88 C

(58) Field of Classification Search ..... 165/44, 165/41, 176; 440/88 C

See application file for complete search history.

(56) References Cited

U.S. PATENT DOCUMENTS

| | | | |
|---|---|---|---|
| 1,838,722 | A | 12/1931 | Watson |
| 2,382,218 | A | 8/1945 | Fernstrum |
| 2,415,154 | A | 2/1947 | Walter |
| 2,914,012 | A | 11/1959 | Godfrey et al. |
| 3,177,936 | A | 4/1965 | Walter |
| 3,240,179 | A | 3/1966 | Van Ranst |

(Continued)

FOREIGN PATENT DOCUMENTS

| | | |
|---|---|---|
| WO | WO 01/31264 A3 | 5/2001 |

(Continued)

OTHER PUBLICATIONS

Catalog 2004—Fernstrum GRIDCOOLER®, cover sheet only.

*Primary Examiner*—John K. Ford
(74) *Attorney, Agent, or Firm*—D. Peter Hochberg; Sean F. Mellino

(57) ABSTRACT

A multiple-pass heat exchanger having opposing headers with beveled end walls, one header having nozzles on opposite sides of a separator wall for delivering heat exchange fluid at one temperature from one or more nozzles on one side of the separator wall, the heat exchanger having one set of fluid flow tubes for conveying the fluid in one direction to the other header and another set of fluid flow tubes for carrying the fluid in the opposite direction from the latter header for delivering to the header with a nozzle or nozzles for discharging the fluid from the latter header at a changed temperature. There is also disclosed a multiple systems combined heat exchanger having an opposing headers with beveled end walls, wherein at least two heat exchangers independent of each other share the respective headers which are divided from each other by separator walls.

16 Claims, 13 Drawing Sheets

U.S. PATENT DOCUMENTS

| | | | |
|---|---|---|---|
| 4,043,289 | A | 8/1977 | Walter |
| 4,338,993 | A | 7/1982 | Fernstrum |
| 4,484,622 | A | 11/1984 | Satchwell |
| 4,557,319 | A | 12/1985 | Arnold |
| 5,299,635 | A | 4/1994 | Abraham |
| 5,529,117 | A | 6/1996 | Voss et al. |
| 5,931,217 | A | 8/1999 | Fernstrum |
| 6,099,373 | A | 8/2000 | Fernstrum |
| 6,575,227 | B1 | 6/2003 | Leeson et al. |
| 6,896,037 | B2 | 5/2005 | Leeson et al. |
| 2003/0098141 | A1 | 5/2003 | Fernstrum |

FOREIGN PATENT DOCUMENTS

| | | | |
|---|---|---|---|
| WO | WO 03/987691 | A1 | 10/2003 |

HEAT EXCHANGER WITH BEVELED HEADER

CROSS REFERENCE TO RELATED APPLICATION

This is a continuation of U.S. Ser. No. 10/119,412 filed Apr. 9, 2002, now U.S. Pat. No. 7,044,194, which itself is continuation-in-part of U.S. Ser. No. 09/427,565 which was filed on Oct. 26, 1999, now abandoned.

BACKGROUND OF THE INVENTION

1. Field of the Invention

This invention relates to heat exchangers, and more particularly to heat exchangers for cooling engines, generators, gear boxes and other heat generating sources in industrial apparatuses having fluid cooled heat sources, such as marine vessels. The invention more particularly relates to open heat exchangers (where beat transfer tubes are exposed to the ambient cooling or heating fluid, rather than being in a shell to shell container holding the cooling or heating fluid) used for cooling heat sources, where the heat exchangers are efficient, and thus have lower weight and volume compared to other heat exchangers known in the art. Alternatively, the heat exchanger according to the invention could be used as a heater, wherein relatively cool fluid absorbs heat through the heat transfer tubes. The invention relates most particularly to multiple-pass heat exchangers and to multiple systems combined heat exchangers.

2. Description of the Prior Art

Heat generating sources in industrial applications such as marine vessels are often cooled by water, other fluids or water mixed with other fluids. For example, in marine vessels used in fresh water and/or salt water, the cooling fluid or coolant flows through the engine or other heat generating source where the coolant picks up heat, and then flows to another part of the plumbing circuit. The heat must be transferred from the coolant to the ambient surroundings, such as the body of water in which the vessel is located. For small engines, such as outboard motors for small boats, ambient water pumped through the engine is a sufficient coolant. However, as the vessel power demand gets larger, ambient water pumped through the engine may continue to provide good cooling of the engine, but also serves as a source of significant contamination damage to the engine. If raw, ambient water were used to cool the engine, the ambient water would carry debris and, particularly if it is salt water, corrosive chemicals to the engine. Therefore, there have been developed various apparatuses for cooling engines and other heat sources. One apparatus for cooling the engine of a vessel is channel steel, which is basically a large quantity of shaped steel which is welded to the bottom of the hull of a vessel for conveying engine coolant and transferring heat from the coolant to the ambient water. Channel steel has severe limitations: it is very inefficient, requiring a large amount of steel in order to obtain the required cooling effect; it is very expensive to attach to a vessel, since it must be welded to the hull—a very labor intensive operation; since channel steel is very heavy, the engine must be large enough to carry the channel steel, rendering both the initial equipment costs and the operating costs very high; the larger, more powerful engines of today are required to carry added channel steel for their cooling capacity with only a relatively small amount of room on the hull to carry it; the payload capacity is decreased; the large amount of channel steel is expensive; and finally, channel steel is inadequate for the present and future demands for cooling modern day, marine vessels. Even though channel steel is the most widely used heat exchanger for vessels, segments of the marine industry are abandoning channel steel and using smaller keel coolers for new construction to overcome the limitations cited earlier.

A keel cooler was developed in the 1940's and is described in U.S. Pat. No. 2,382,218 (Fernstrum). The Fernstrum patent describes a heat exchanger for attachment to a marine hull structure which is composed of a pair of spaced headers secured to the hull, and a plurality of heat conduction tubes, each of whose cross-section is rectangular, which extend between the headers. Cylindrical plumbing through the hull connects the headers to coolant flow lines extending from the engine or other heat source. Hot coolant leaves the engine, and runs into a heat exchanger header located beneath the water level (the water level refers to the water level preferably below the aerated water, i.e. below the level where foam and bubbles occur), either beneath the hull or on at least one of the lower sides of the hull. The coolant then flows through the rectangular heat conduction tubes and goes to the opposite header, from which the cooled coolant returns to the engine. The headers and the heat conduction tubes are disposed in the ambient water, and heat transferred from the coolant, travels through the walls of the heat conduction tubes and the headers, and into the ambient water. The rectangular tubes connecting the two headers are spaced fairly close to each other, to create a large heat flow surface area, while maintaining a relatively compact size and shape. Frequently, these keel coolers are disposed in recesses on the bottom of the hull of a vessel, and sometimes are mounted on the side of the vessel, but in all cases below the water line.

The foregoing keel cooler is referred to as a one-piece keel cooler, since it is an integral unit with its major components welded or brazed in place. The one-piece keel cooler is generally installed and removed in its entirety.

It is explained in U.S. Pat. No. 2,382,218 that, according to one embodiment of the heat exchanger disclosed therein, the pair of headers at opposite ends thereof have beveled fore and aft front and rear end walls. The latter walls are respectively connected to beveled front and rear inner walls (to which the open ports of the conduction tubes are connected to the chambers of the headers) by triangular-shaped side walls. There is thus no flat lower wall (since the triangular-shaped end walls meet at a point). Each header thus essentially consists of a flat rectangular upper wall, beveled inner and end walls extending downwardly from opposite ends of the upper wall and meeting at a lower point, and triangular side walls. The coolant inlet or outlet nipple is positioned in the upper wall directly over the point where the beveled inner wall meets the beveled end wall. Since the walls beneath the nipples are beveled in opposite directions, the flow of coolant to or from the nipples is helped in one respect because the fore and aft end parts of the header assists the coolant flow between the conduction tubes and the nipple, but hindered in another respect because the beveled inner walls direct coolant flow in the opposite direction from that rebounding from the end parts of the header. The oppositely directed coolant flow in the header causes turbulence, increases pressure drop and reduces coolant flow. The lower portion of each header, where the beveled inner and end wall converge at a point, is disposed below the open ports of the conduction tubes. This further reduces the coolant flow into and out of the respective headers; in the case of coolant flowing out of a header, coolant disposed below the ports must flow upward to reach the ports, against other coolant flowing downwardly. Such upward flow contributes to turbulence in the header, and is inefficient since gravity opposes such flow. Likewise, when coolant is flowing into this type of header to exit through the nipple, some coolant flows in the direction opposite to that of the nipple and must flow against gravity, past the cross-flow of coolant from the ports of the conduction tubes into the nipple. The latter arrangement also results in turbulence in the header, an increase in the pressure drop, and reduces coolant flow. In addition, none of the open ports are located in the coolant flow path from the nipple, so there is no direct flow path between the nipple and any of the open ports.

Furthermore, the beveled end wall is not configured either to direct a substantial amount of coolant into the flow tubes, or to direct a substantial amount of coolant from the flow tubes into the nozzle. This is because part of the beveled end wall is located below the open ports to the flow tubes, and because there are significant parts of the beveled inner wall which are flat and devoid of ports to the flow tubes.

These aspects of this embodiment of the heat exchanger disclosed in U.S. Pat. No. 2,382,218 may very well have determined why it was never put into commercial production.

There are various varieties of one-piece keel coolers. Sometimes the keel cooler is a multiple-pass keel cooler where the headers and heat conduction tubes are arranged to allow at least one 180° change in the direction of flow, and the inlet and outlet ports may be located in the same header.

Even though the foregoing heat exchangers with the rectangular heat conduction tubes have enjoyed widespread use since their introduction over fifty years ago, they have shortcomings which are corrected by the present invention.

The rectangular heat exchangers of the prior art have the outward shape of a rectangular parallelepiped having headers at their opposite ends. These headers have opposing end walls which are perpendicular to the hull of the vessel and parallel to each other, and act as a barrier to ambient water flow relative to the keel cooler as the vessel with the heat exchanger travels through the water. The perpendicular header walls are responsible for the creation of dead spots (lack of ambient water flow) on the heat exchanger surfaces, which largely reduce the amount of heat transfer occurring at the dead spots. In addition, the perpendicular walls diminish the flow of ambient water between the heat conduction tubes, which reduces or diminishes the amount of heat which can be transferred between the coolant in the tubes and the ambient water.

As discussed below, the beveled header contributes to the increase of the overall heat transfer efficiency of the keel cooler according to the invention, since the ambient water is caused to flow towards and between the respective heat conduction tubes, rendering the heat transfer substantially higher than in the keel cooler presently being used. This increase in heat transfer is due at least in part to the increase in turbulence in the flow of ambient water across the forward header and along and between the coolant flow tubes.

One of the important aspects of keel coolers for vessels is the requirement that they take up as small an area on the vessel as possible, while fulfilling or exceeding their heat exchange requirement with minimized pressure drops in coolant flow. The area on the vessel hull which is used to accommodate a keel cooler is referred to in the art as the footprint. In general, keel coolers with the smallest footprint and least internal pressure drops are desirable. One of the reasons that the keel cooler described above with the rectangular heat conduction tubes has become so popular is because of the small footprint it requires when compared with other keel coolers. However, keel coolers according to the design of rectangular tubed keel coolers presently being used have been found by the present inventors to be larger than necessary both in terms of size and the related internal pressure drop. By the incorporation of the various aspects of the present invention described above (and in further detail below), keel coolers having smaller footprints and lower internal pressure drops are possible. These are major advantages of the present invention.

When multiple-pass (usually two-pass) keel coolers are specified for the present state of the art, an even greater differential size is required when compared with the present invention, as described below.

SUMMARY OF THE INVENTION

It is an object of the present invention to provide a heat exchanger for fluid cooled heat sources which is smaller than corresponding heat exchangers having the same heat exchange capability.

Another object of the present invention is to provide an improved heat exchanger for industrial applications which is more efficient than heat exchangers presently known and used.

It is yet another object of the present invention to provide an improved one-piece heat exchanger for vessels which is more efficient in heat transfer than presently known one-piece heat exchangers.

A further object is to provide an improved one-piece heat exchanger which reduces the pressure drop of coolant flowing therethrough.

A further object of the present invention is to provide an improved one-piece heat exchanger having heat conduction tubes which are rectangular in cross-section having a length which is reduced in size from the current heat exchangers due to enhanced ambient water flow across the keel cooler.

Another object is to provide an improved one-piece heat exchanger having a reduced size from present one-piece heat exchangers of comparable heat transfer capability, by reducing the length of the heat transfer tubes, the number of tubes and/or the size of the tubes.

Another object of the present invention is to provide a header for a one-piece keel cooler heat exchanger with an interior wall for improving the coolant flow between the inlet/outlet and the open ports of the keel cooler tubes.

It is yet another object to provide a header for a one-piece keel cooler with an interior wall for directing the coolant flow between the inlet/outlet and the open ports of the keel cooler tubes for reducing turbulence of the coolant in the header.

A still further object of the present invention is to provide a new one-piece heat exchanger having rectangular shaped heat conduction tubes which has enhanced durability compared to keel coolers presently on the market.

A related object of the invention is to provide an improved heat exchanger and headers thereof which is capable of deflecting debris more readily, and for presenting a smaller target to debris in the ambient water.

Another object of the present invention is to provide an improved one-piece keel cooler which is easier to install on vessels than corresponding keel coolers presently on the market.

Yet a further object of the present invention is to provide a one-piece heat exchanger and a header having a lower weight, and therefore lower cost, than corresponding one-piece heat exchangers presently in use.

Another object of the present invention is to provide a one-piece heat exchanger and headers thereof having rectangular heat conduction tubes having a lower pressure drop in coolant flowing through the heat exchanger than corresponding heat exchangers presently known.

Another object of the present invention is the provision of a one-piece heat exchanger for a vessel, for use as a retrofit for previously installed one-piece heat exchangers which will surpass the overall heat transfer performance and provide lower pressure drops than the prior units without requiring additional plumbing, or requiring additional space requirements, to accommodate a greater heat output.

It is another object of the invention to provide an improved header for a one-piece heat exchanger having rectangular coolant flow tubes.

Another object is to provide an improved header for a one-piece heat exchanger with rectangular coolant flow tubes which reduces the dead spots which have heretofore reduced the heat transfer capabilities of one-piece heat exchangers, the dead spots reducing the flow of ambient water around and between the coolant flow tubes.

A further object of the invention is to provide an improved header for a one-piece keel cooler with rectangular coolant flow tubes, by reducing the likelihood of damage to the header from striking debris and underwater objects which could damage the keel cooler.

It is still another object for the provision of a header for effecting increased turbulent flow of the ambient water flowing between and around the heat transfer tubes.

It is an additional object to provide an improved header for one-piece keel coolers which enables the anode for such keel coolers to be less likely to strike debris and underwater objects.

Another object is the provision of a keel cooler having a smaller, and more streamlined profile to reduce drag as the vessel with the keel cooler moves through the ambient water.

Another object is to provide a header for a one-piece heat exchanger which provides for enhanced heat exchange between the coolant and the ambient cooling medium such as water.

A further object to the provision of an improved multiple-pass heat exchanger.

A still additional object is the provision of an improved multiple systems combined heat exchanger.

A general object of the present invention is to provide a one-piece heat exchanger and headers thereof which is efficient and effective in manufacture and use.

Other objects will become apparent from the description to follow and from the appended claims.

The invention to which this application is directed is a one-piece heat exchanger, i.e. heat exchangers having two headers which are integral with coolant flow tubes. It is particularly applicable to heat exchangers used on marine vessels as discussed earlier, which in that context are also called keel coolers. However, heat exchangers according to the present invention can also be used for cooling heat generating sources (or heating cool or cold fluid) in other situations such as industrial and scientific equipment, and therefore the term heat exchangers covers the broader description of the product discussed herein. The heat exchanger includes two headers, and one or more coolant flow tubes integral with the header. Although keel coolers use ambient water as the cooling medium, the broader term for a cooling medium is a heat sink or a fluid heat sink.

DESCRIPTION OF THE PREFERRED EMBODIMENTS

Figure 1:
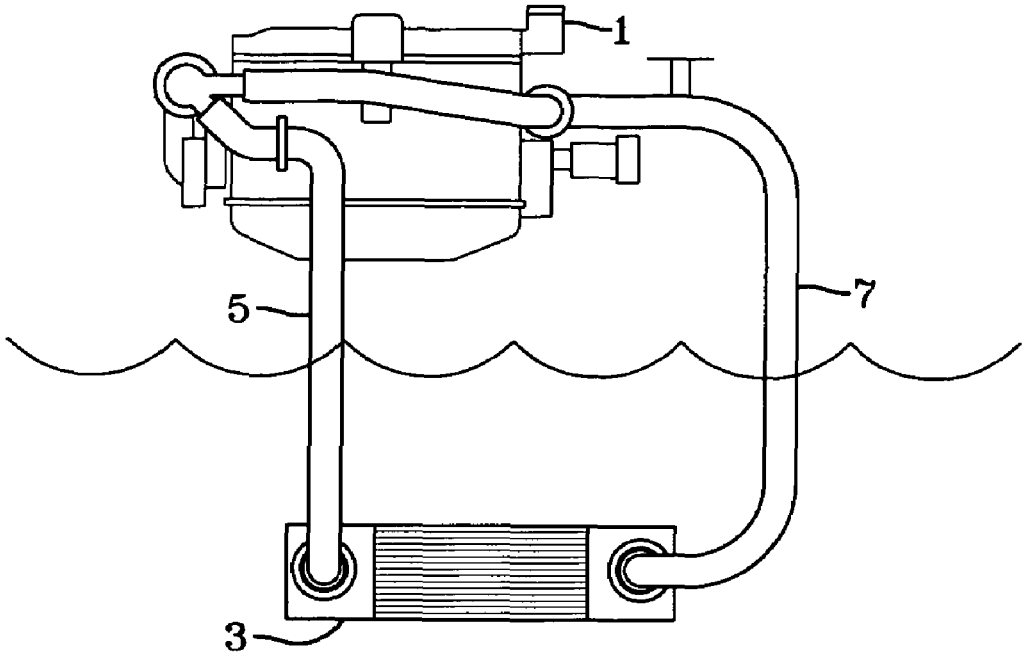
FIG. 1 is a schematic view of a heat exchanger on a vessel in the water.

The fundamental components of a heat exchanger system for a water-going vessel are shown in FIG. 1. The system includes a heat source 1, a heat exchanger 3, a pipe 5 for conveying the hot coolant from heat source 1 to heat exchanger 3, and a pipe 7 for conveying cooled coolant from heat exchanger 3 to heat source 1. Heat source 1 could be an engine, a generator or other heat source for the vessel. Heat exchanger 3 could be a one-piece keel cooler (since only one-piece keel coolers are discussed herein, they are generally only referred to herein as "keel coolers.") Heat exchanger 3 is located in the ambient water, below the water line (i.e. below the aerated water line), and heat from the hot coolant is transferred through the walls of heat exchanger 3 and expelled into the cooler ambient water.

Figure 2:
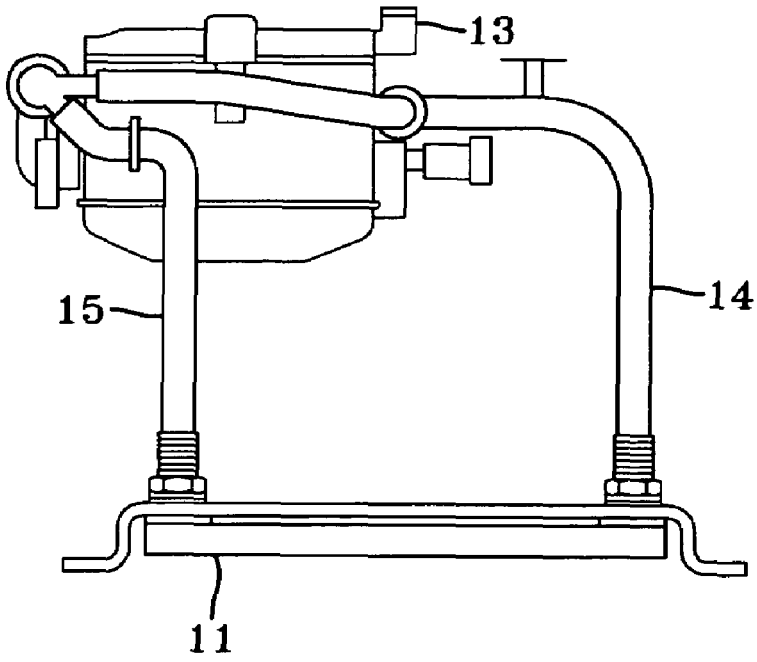
FIG-2 PRIOR ART
FIG. 2 is a side view of an engine for a vessel having a one-piece keel cooler according to the prior art installed on the vessel and connected to the engine.

FIG. 2 shows a heat exchanger 11 mounted on a vessel, for transferring heat from the coolant flowing from an engine or other heat source 13 to the ambient water. Coolant flows from one of lines 14 or 15 from engine 13 to keel cooler 11, and back through the other flow line from keel cooler 11 to engine 13. Keel cooler 11 is attached to, but spaced from the hull of a vessel. Keel cooler 11 is shown in prior art form.

Figure 3:
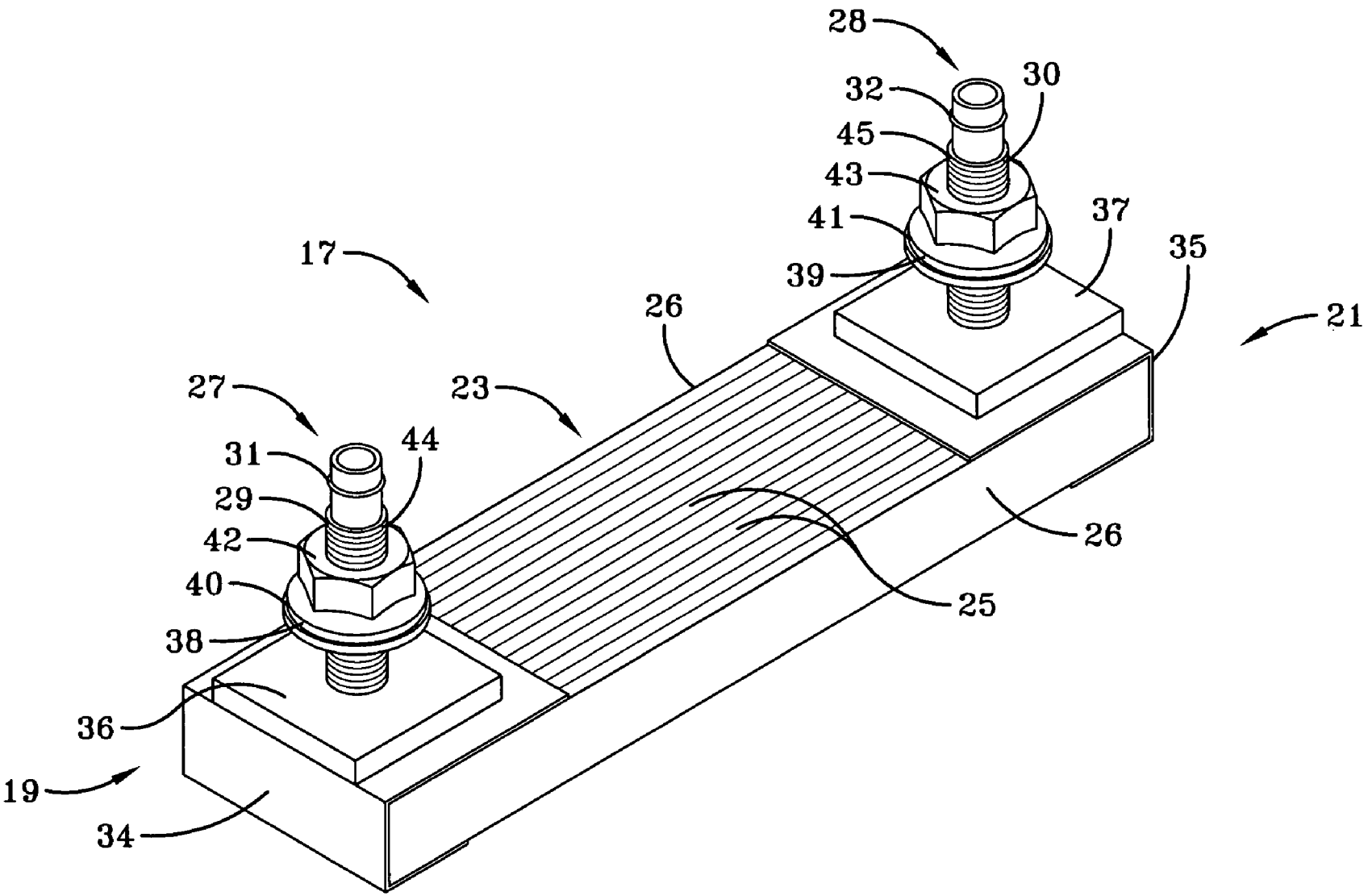
FIG. 3 is a pictorial view of a keel cooler according to the prior art.

A keel cooler 17 according to the prior art is shown in FIG. 3. It includes a pair of headers 19, 21 at opposite ends of a set of parallel, rectangular coolant flow tubes 23, having interior tubes 25 and two outermost tubes (discussed below). A pair of nozzles 27, 28 conduct coolant into and out of keel cooler 17. Nozzles 27, 28 have cylindrical threaded connectors 29, 30, and nipples 31, 32 at the ends of the nozzles. Headers 19, 21 have a generally prismatic construction, and their ends 34, 35 are perpendicular to the parallel planes in which the upper and lower surfaces of tubes 23 are located. Keel cooler 17 is connected to the hull of a vessel through which nozzles 27 and 28 extend. Large gaskets 36, 37 each have one side against headers 19, 21 respectively, and the other side engages the hull of the vessel. Rubber washers 38, 39 are disposed on the inside of the hull when keel cooler 17 is installed on a vessel, and metal washers 40, 41 sit on rubber washers 38, 39. Nuts 42, 43, which typically are made from metal compatible with the nozzle, screw down on sets of threads 44, 45 on connectors 29, 30 to tighten the gaskets and rubber washers against the hull to hold keel cooler 17 in place and seal the hull penetrations from leaks.

Figure 4:
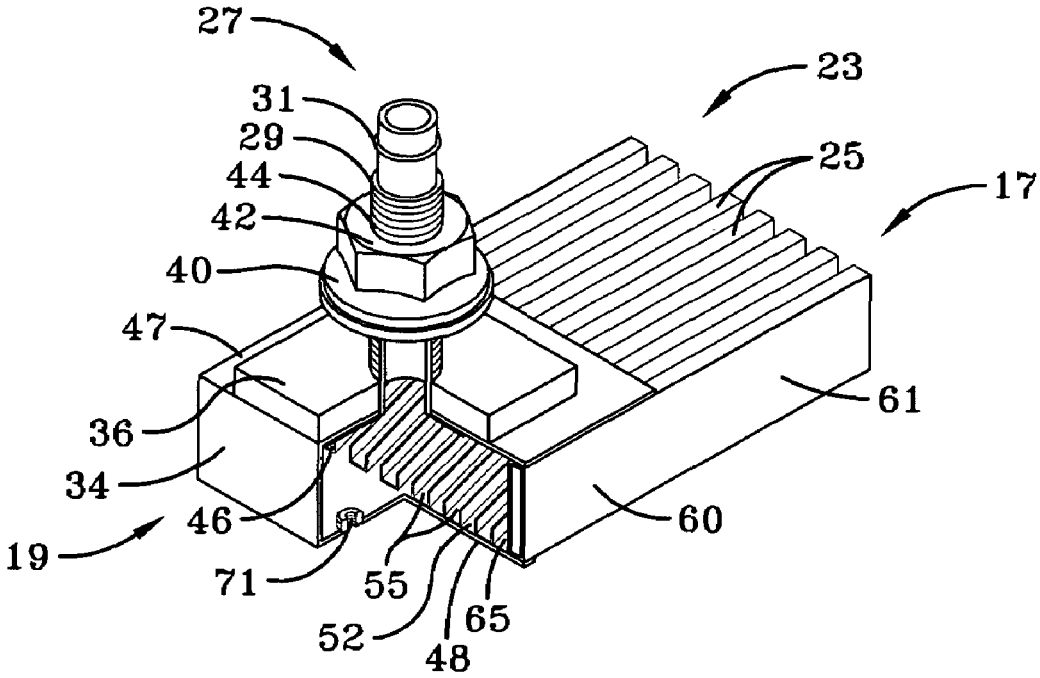
FIG-4 PRIOR ART
FIG. 4 is a partial pictorial view of a partially cut-away header and a portion of the coolant flow tubes of a one-piece keel cooler according to the prior art.

Turning to FIG. 4, a partial, cross section of the current keel cooler according to the prior art and depicted in FIG. 3; is shown. Keel cooler 17 is composed of the set of parallel heat conduction or coolant flow tubes 23 and the header or manifold 19. Nozzle 27 is connected to header 19 as described below. Nozzle 27 has nipple 31, and connector 29 has threads 44 as described above, as well as washer 40 and nut 42. Nipple 31 of nozzle 27 is normally brazed or welded inside of a connector 29 which extends inside the hull. Header 19 has an upper wall or roof 47, outer back wall 34, and a bottom wall or floor 48. Header 19 includes a series of fingers 52 which are inclined with respect to tubes 23, and define spaces to receive ends 55 of interior tubes 25.

Figure 5:
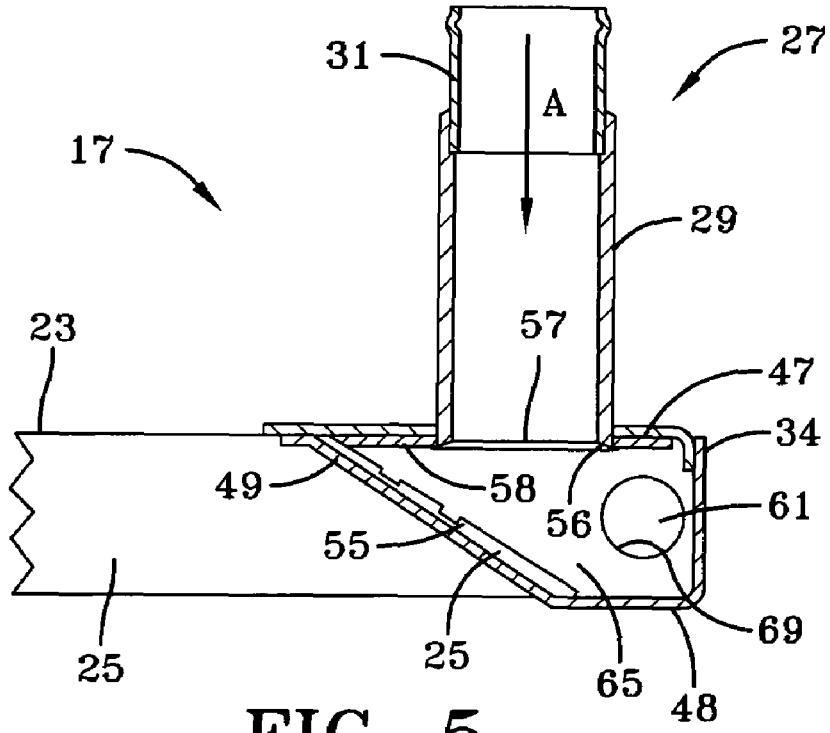
FIG-5 PRIOR ART
FIG. 5 is a cross-sectional view of a portion of a keel cooler according to the prior art, showing a header and part of the coolant flow tubes.
Figure 6:
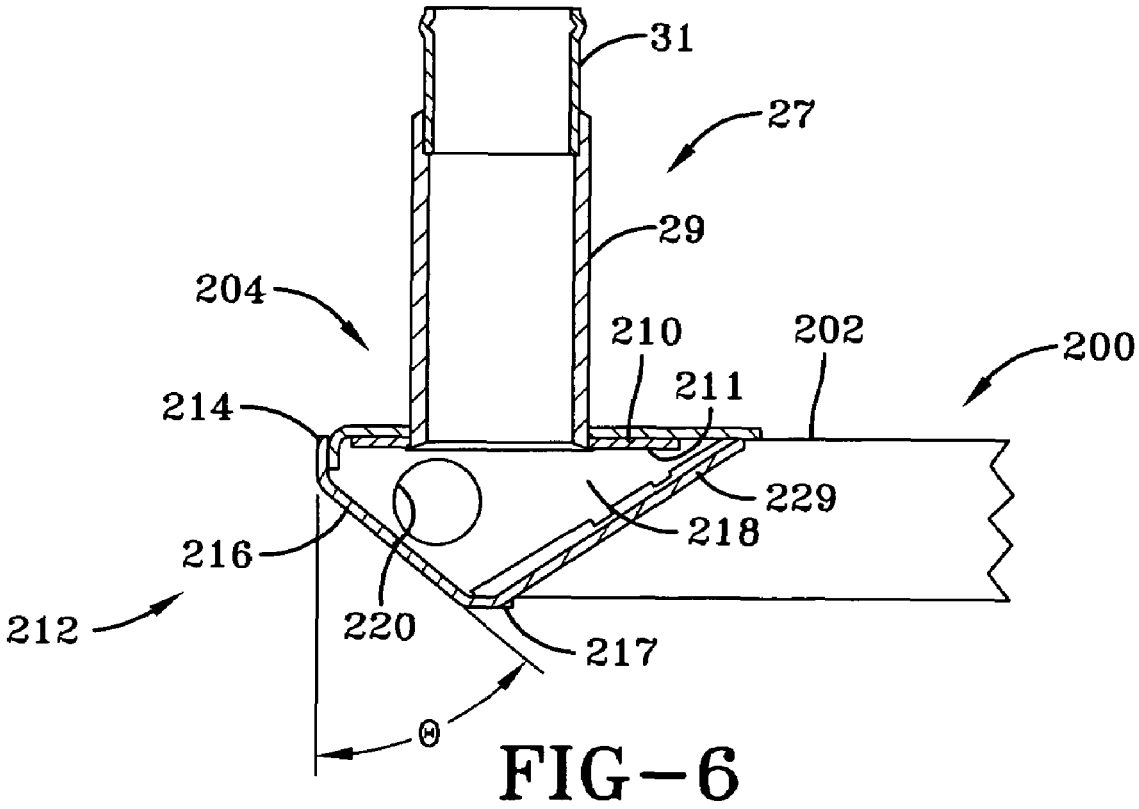
FIG. 6 is a side, cross-sectional, partial view of a portion of one-piece keel cooler according to the invention, showing a header and part of the coolant flow tubes.
Figure 8:
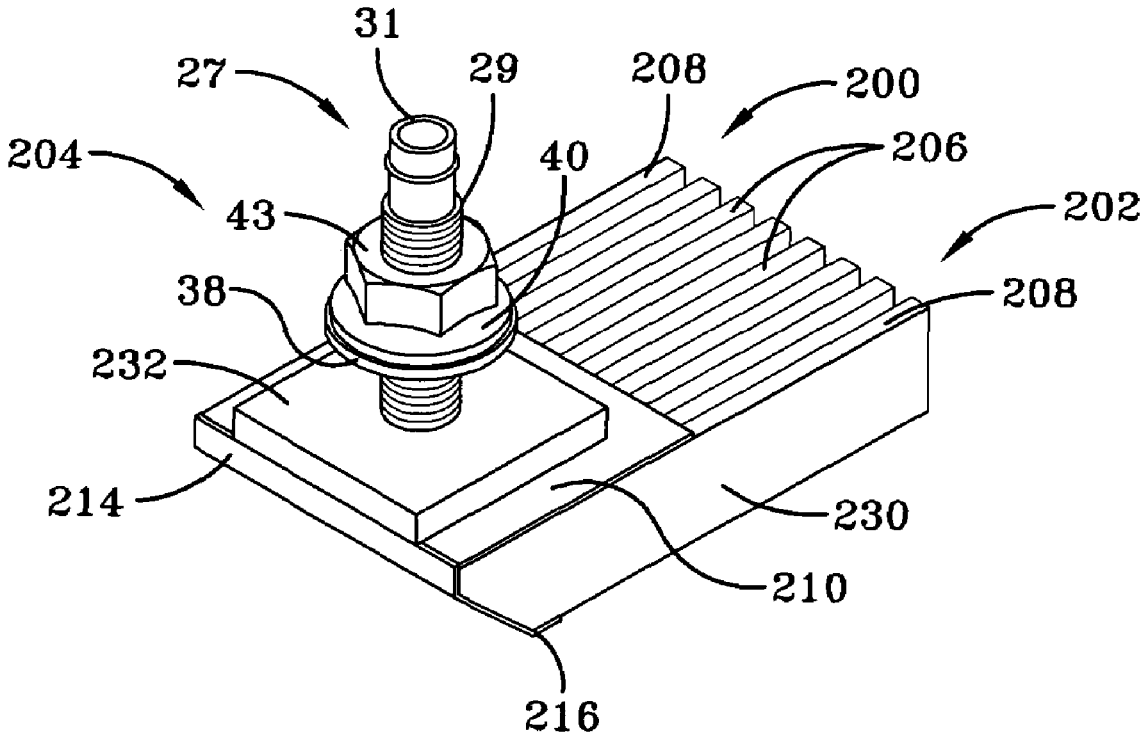
FIG. 8 is a pictorial view of a header and part of the coolant flow tubes of a one-piece keel cooler according to the invention.
Figure 9:
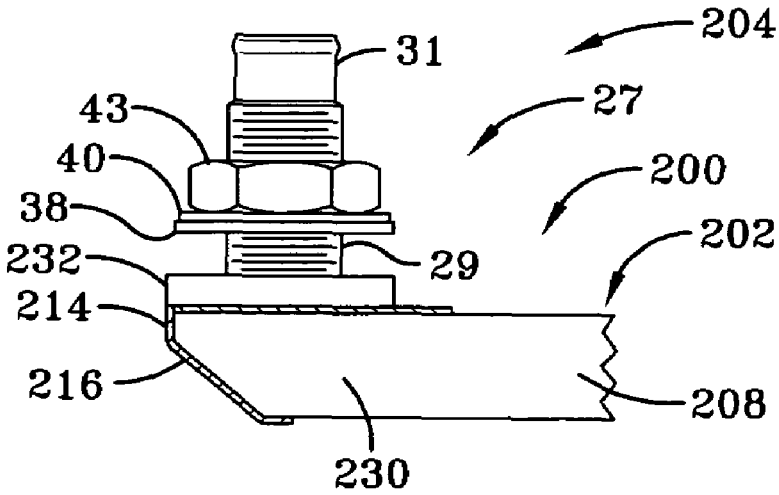
FIG. 9 is a side view of part of the apparatus shown in FIG. 8.
Figure 10:
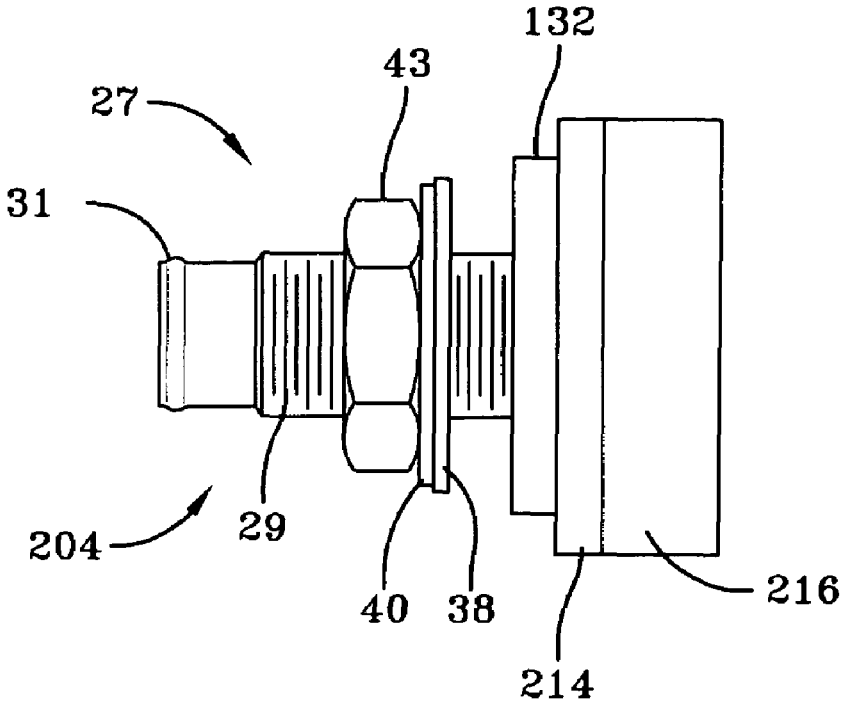
FIG. 10 is a front view of the apparatus shown in FIG. 8.
Figure 11:
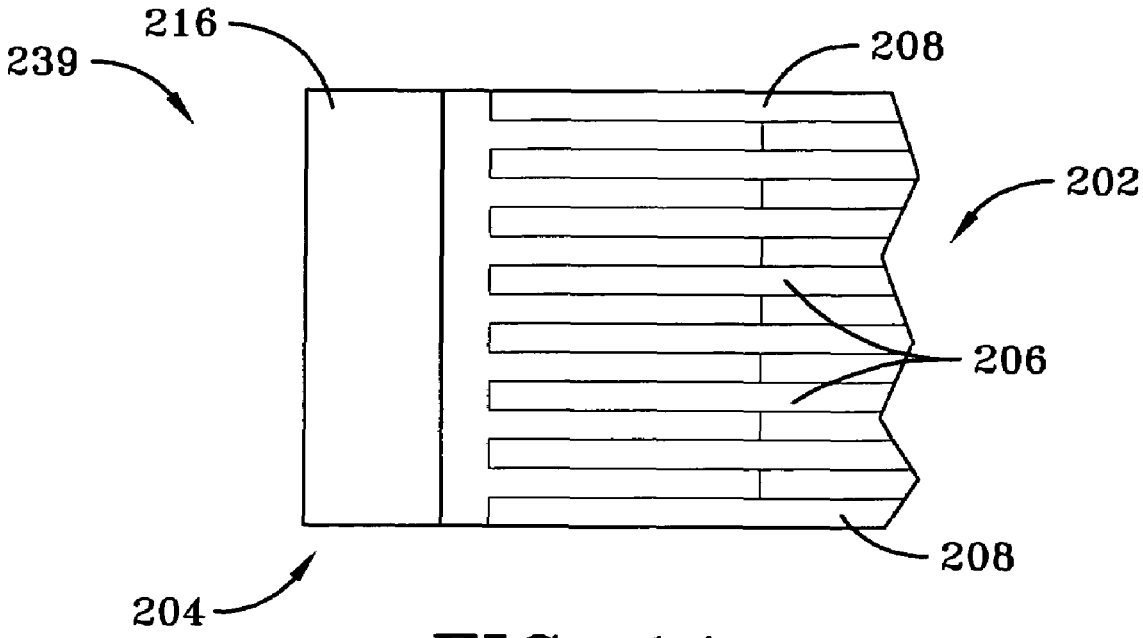
FIG. 11 is a partial bottom view of the apparatus shown in FIG. 8.

Referring also to FIG. 5, which shows keel cooler 17 and header 19 in cross section, header 19 further includes an inclined surface 49 composed of fingers 52. End portions 55 of interior tubes 25 extend through surface 49. Interior tubes 25 are brazed or welded to fingers 52 to form a continuous surface. A flange 56 surrounds an inside orifice 57 through which nozzle 27 extends and is provided for helping support nozzle 27 in a perpendicular position on the header 19. Flange 56 engages a reinforcement plate 58 on the underside of wall 47.

In the discussion above and to follow, the terms "upper", "inner", "downward", "end", etc., refer to the heat exchanger, keel cooler or header as viewed in a horizontal position as shown in FIG. 5. This is done realizing that these units, such as when used on water going vessels, can be mounted on the side of the vessel, or inclined on the fore or aft end of the hull, or various other positions.

Each exterior side wall of header 19 is comprised of an exterior or outer rectangular tube, one of which is indicated by numeral 60 in FIG. 4. The outer tubes extend into header 19. FIGS. 4 and 5 show both sides of outside tube wall 61. Both sides of interior wall 65 are shown in FIGS. 4 and 5. A circular orifice 69 is shown extending through interior wall 65 of the outside rectangular tube of keel cooler 17, and is provided for carrying coolant flowing through the outside tube into or out of header 19. In this regard, nozzle 27 can either be an inlet conduit for receiving hot coolant from the engine whose flow is indicated by the arrow A in FIG. 5, or be an outlet conduit for receiving cooled coolant from header 19 for circulation back to the heat source.

FIG. 4 also shows that keel cooler header 19 has a drainage orifice 71 for receiving a correspondingly threaded and removable plug. The contents of keel cooler 17 can be removed through orifice 71.

Still referring to the prior art header 19 shown in FIGS. 3-5, it can be seen that outer back wall 34 and floor 48 are formed at right angles. This configuration has led to a number of disadvantages, previously unrecognized by those designing and working on keel coolers. First, by having wall 34 perpendicular to the direction of flow of the coolant through the tubes, greater pressure drops occur inside of header 19 as the coolant becomes chaotically turbulent and is forced through the coolant flow tubes at varying flow rates depending on resistance. This leads to a net reduction in flow and thus of heat transferred from the coolant through tubes 23 of keel cooler 17. With respect to the outside of wall 34, the vertical wall acts as an obstruction to the flow of ambient water, and diminishes the amount of ambient water which is able to flow between and around tubes 23. In addition, vertical wall 34 serves as an obstruction to debris in the ambient water and absorbs the full impact of the debris leading to potential damage to the keel cooler. Moreover, having wall 34 and floor 48 defining a right angle increases the amount of material used for keel cooler 17, which adds to its expense. Most keel coolers are made from 90-10 copper-nickel (or some other material having a large amount of copper), which is a relatively expensive material. In addition, significant drag is created by the resistance which the vertical wall presents to ambient water. This restricts the flow of ambient water to the heat exchange tubes of the keel cooler, and adds to the drag of the vessel as it moves through the water.

Still referring to FIGS. 3-5, gaskets 36, 37 are provided for three essential purposes: (1) they insulate the header to prevent galvanic corrosion, (2) they eliminate infiltration of ambient water into the vessel, and (3) they permit heat transfer in the space between the keel cooler tubes and the vessel by creating a distance of separation between the heat exchanger and the vessel hull, allowing ambient water to flow through that space. Gaskets 36, 37 are generally made from a polymeric substance. In typical situations, gaskets 36, 37 are between one-quarter inch and three-quarter inch thick. Keel cooler 17 is installed on a vessel as explained above. The plumbing from the vessel is attached by means of hoses to nipple 31 and connector 29 and to nipple 32 and connector 30. A cofferdam or sea chest (part of the vessel) at each end (not shown) contains both the portion of the nozzle 27 and nut 42 directly inside the hull. Sea chests are provided to prevent the flow of ambient water into the vessel should the keel cooler be severely damaged or torn away, where ambient water would otherwise flow with little restriction into the vessel at the penetration location.

Referring next to FIGS. 6-11, the invention in the preferred embodiment is shown. The embodiment includes a keel cooler 200 with coolant flow tubes (or heat transfer fluid flow tubes, since in some instances the fluid may be heated instead of cooled) 202 having a generally rectangular cross section. Coolant flow tubes 202 have a bottom portion 203. A header 204 is an integral part of keel cooler 200. Tubes 202 include interior or inner coolant flow tubes 206 and outermost or exterior tubes 208. A nozzle 27 having nipple 31 and threaded connector 29 is the same as those described earlier and are attached to the header. Header 204 includes an upper wall or roof 210 having interior surfaces 211 facing the chamber of the header, a beveled closed end portion 212 having an end wall 214 transverse to (and preferably perpendicular to) upper wall 210 and a beveled wall 216 beginning at end wall 214 and terminating at a generally flat lower wall or bottommost portion 217, the bottommost portion of the header. Bottommost portion or lower wall 217 is not above bottom portions 203 of coolant flow tubes 202 to provide an enhanced ambient fluid flow pattern as compared to a heat exchanger having a header with a bottommost portion below the bottom portion of the coolant flow tubes. Beveled wall 216 should be greater in length (from end wall 214 to lower wall 217) than the height of end wall 214. An interior wall 218 (FIGS. 6-7) of exterior or outermost rectangular flow tube 208 has an orifice 220 (one per header for each tube 208) which is provided as a coolant flow port for coolant flowing between the chamber of header 204 and outer flow tubes 208. (The chamber is defined by upper wall 210, an inclined surface or inner end or inlet end portion 229, beveled wall 216, lower wall 217 and end wall 214.) Header 204 also has an anode assembly (not shown) for reducing corrosion of the keel cooler.

Figure 7:
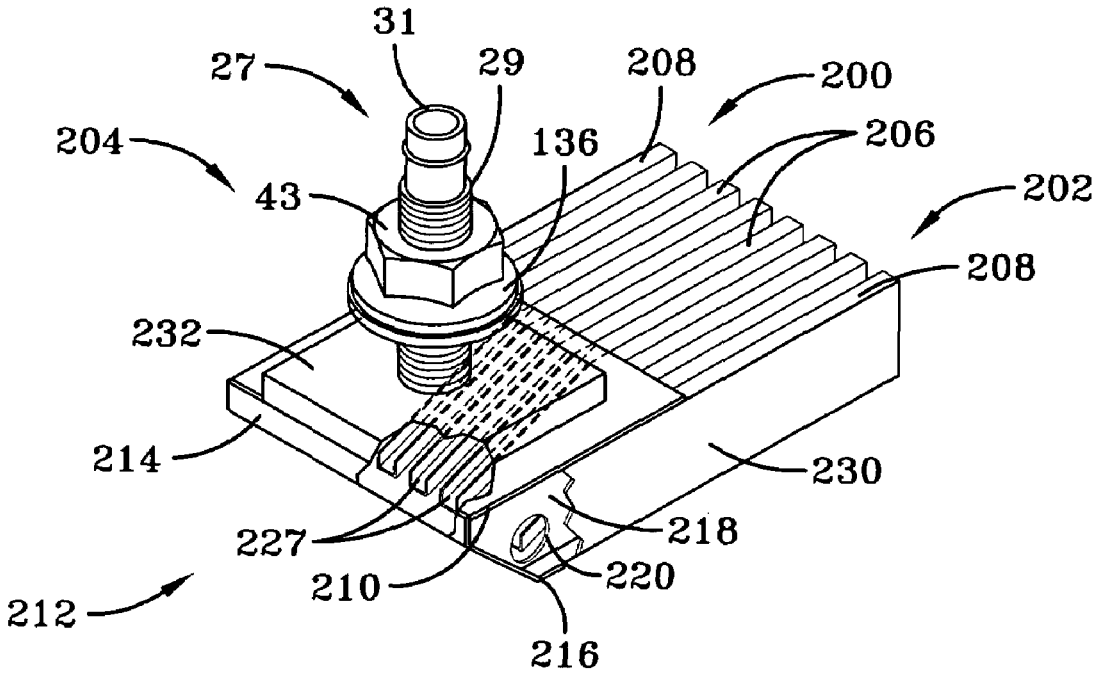
FIG. 7 is a pictorial view of a portion of a one-piece keel cooler according to the invention, with portions cut away.

Considering specifically cut away FIG. 7, keel cooler 200 includes rectangular tubes 202 with interior tubes 206 and outermost tubes 208, and inner wall 218 (with orifice 220) of the outermost tubes. The open ends or inlets or ports for interior tubes 206 are shown by numerals 227. Tubes 206 join header 204 through inclined surface 229 (FIG. 6) on the opposite part of header 204 from beveled wall 216. Exterior tubes 208 have outer walls or exterior surfaces 230, part of which are also the side walls of header 204. A gasket 232, similar to and for the same purpose as gasket 36, is disposed on roof 210.

The angle of beveled wall 216 is an important part of the present invention. As discussed herein, the angle, designated as θ (theta), is appropriately measured from the plane perpendicular to the longitudinal direction of coolant flow tubes 202 and located at the part of the closed end portion of header 204 spaced furthest from the set of open ends or ports 227 of tubes 206, i.e. from end wall 214, to beveled wall 216. Angle θ is described as an exterior angle, since it is exterior to end wall 214 and beveled wall 216; it is measured from a plane perpendicular to the longitudinal axes of the flow tubes 202 and roof 210, and it is along end wall 214 at the beginning of beveled wall 216. The factors for determining angle θ are to maintain the center-to center distance of the nozzle spacing, to maintain the overall length of the keel cooler, to provide vertical drop beneath the roof of the header so that the header can hold the anode insert, to keep the anode assembly from extending longitudinally beyond wall 214, and to allow for the maximum length of heat transfer tubing (and the associated reduction of the length of the header). Angle θ could be affected by the size of orifice 220, but generally the other factors limit angle θ before the orifice would affect it.

Another important aspect to beveled wall 216 is the manner in which it directs the flow of ambient water over and between the exterior walls of coolant flow tubes 202, to increase the heat transfer between the coolant inside the tubes and the outside ambient water. It will be recalled that under the prior art as shown in FIGS. 3-5, vertical wall 34 diverted the ambient water as the vessel passed therethrough, so that the ambient water to a significant extent went around rather than between and over the separated rectangular tubes 27.

Figure 12:
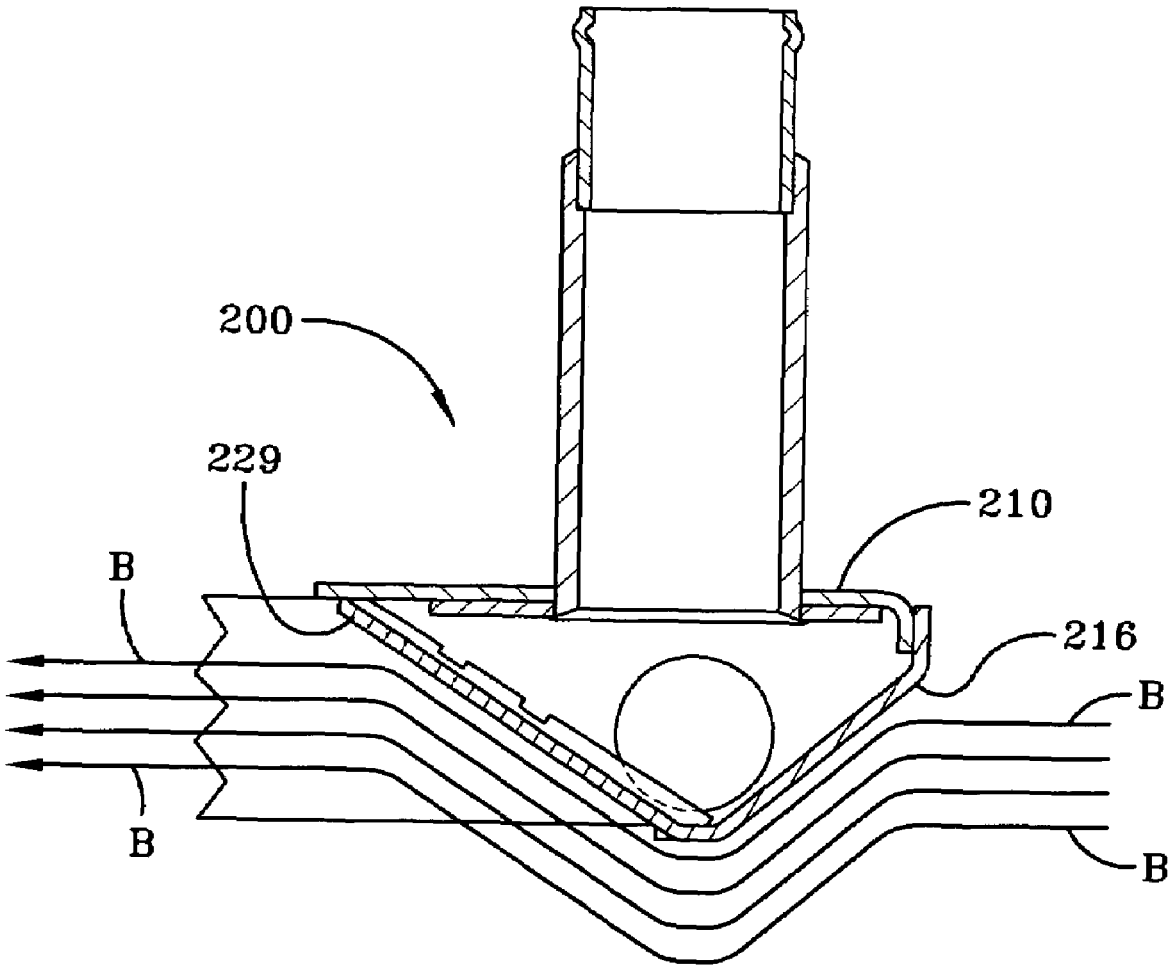
FIG. 12 is a side view of a portion of a header according to the invention showing the flow lines of ambient water.

Referring to FIG. 12, which shows a side view of keel cooler 200, arrows B show the flow pattern of ambient water across keel cooler 200 as the keel cooler moves to the right through the ambient water. Arrows B show that the water impinges on beveled wall 216, flows around the beveled wall, and, due to the drop in pressure, along inclined surface 229 and up and between coolant flow tubes 202. This flow is turbulent which greatly increases the transfer of heat from the heat conduction tubes as compared to the prior art shown in FIGS. 3-5, yielding a more efficient and effective heat exchanger than those of the prior art.

It can be seen that outer exterior surfaces 230 define an envelope transverse to the longitudinal direction of the keel cooler. The envelope has a height equal to the exterior height of exterior tubes 208, and a width equal to the distance between outer exterior surfaces 230. Header 204 thus has an exterior width equal to the width of the envelope and an interior height defined by the interior surfaces of upper wall 210 and lower wall 217, and therefore of the envelope.

Figure 14:
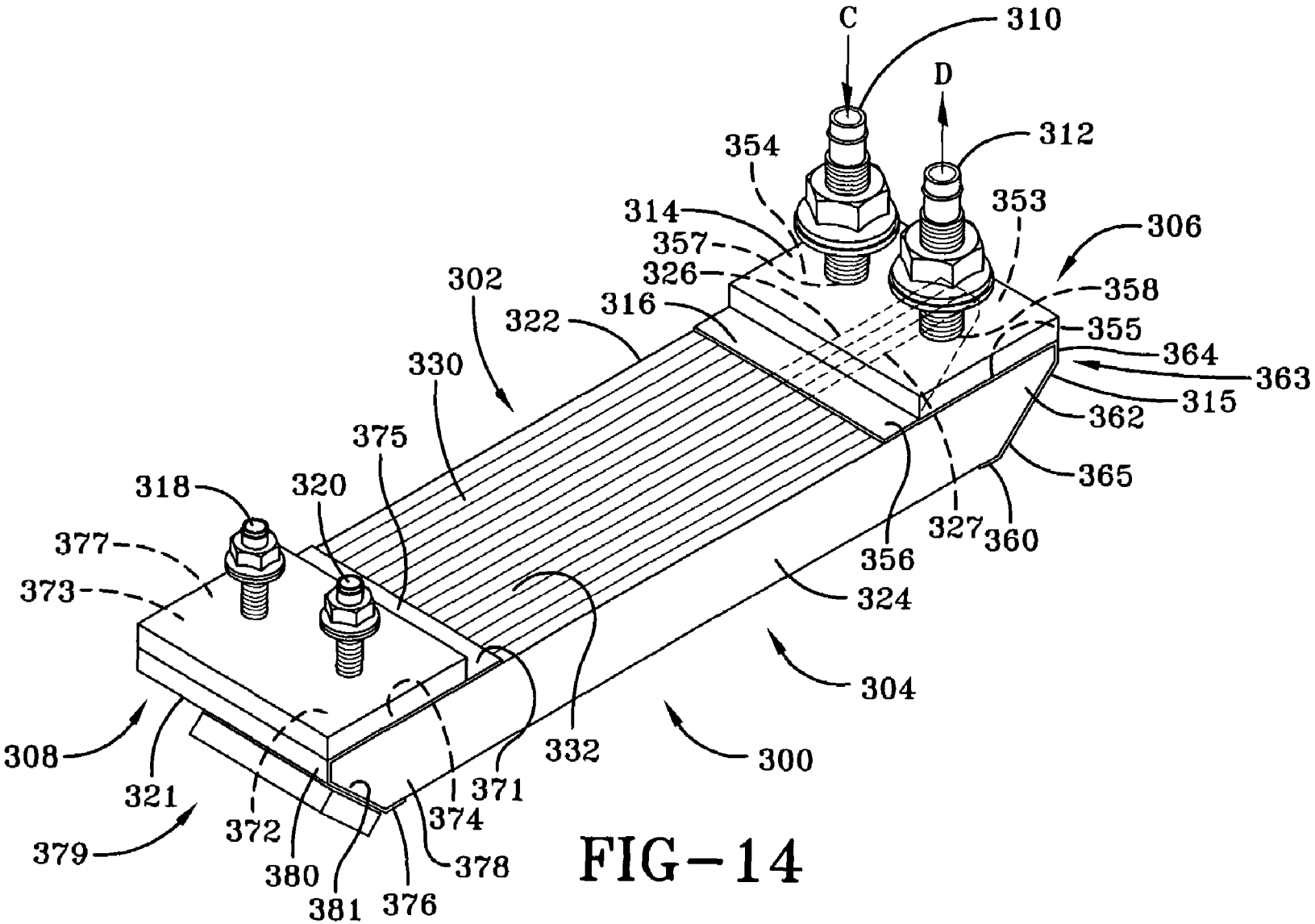
FIG. 14 is a pictorial view of a two-pass keel cooler system according to the invention.
Figure 15:
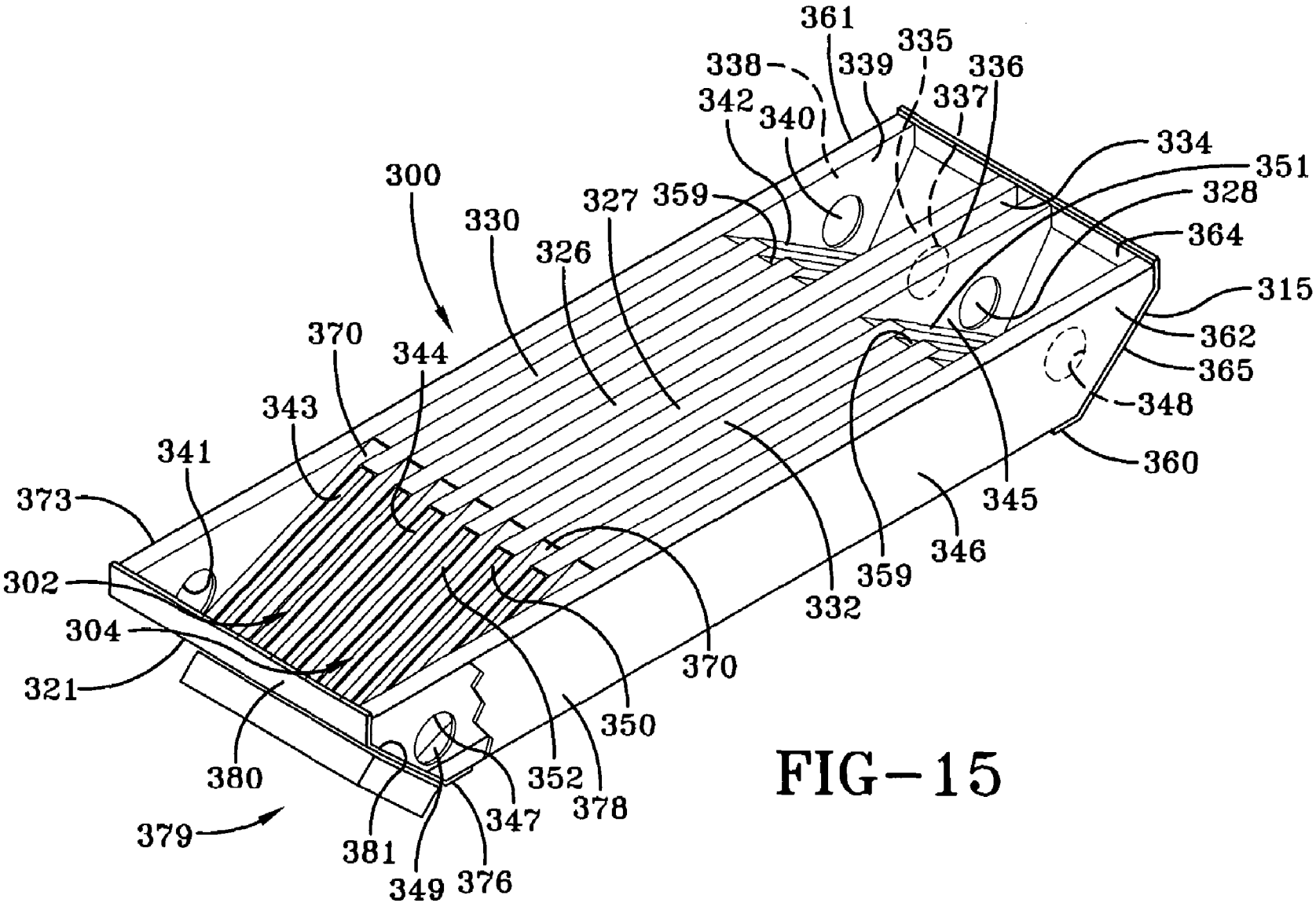
FIG. 15 is a cut away view of a portion of the header shown in FIG. 16.

So far, only single-pass keel cooler systems have been described. In two-pass systems, the inlet and outlet nozzles are both disposed in one header, and coolant flows into the header via an inlet nozzle, through a first set of tubes from the first header into the second header (with no nozzles), and then back through a second set of tubes at a lower pressure—and finally out from the header via an outlet nozzle. Referring to FIGS. 14 and 15, a two-pass keel cooler 300 according to the invention is shown. Keel cooler 300 has two sets of coolant flow tubes 302, 304, a header 306 and an opposite header 308. Header 306 has an inlet nozzle 310 and an outlet nozzle 312, which extend through a gasket 314. Header 306 further has a beveled end wall 315 having the advantages with respect to both internal coolant flow and to ambient water flow as discussed earlier. Gasket(s) 314 is located on roof 316 of header 306. The other header 308 has no nozzles, but rather has one or two stud bolt assemblies 318, 320 for connecting the portion of the keel cooler which includes header 308 to the hull of the vessel. Header 308 has a beveled end wall 321 which provides the advantages over flat end walls with respect to ambient water flow as explained above. The hot coolant from the engine or generator of the vessel enters nozzle 310 as shown by arrow C, and the cooled coolant returns to the engine from header 306 through outlet nozzle 312 shown by the arrow D. Outermost tubes 322, 324 are like outer tubes 208 in FIGS. 7, 8 and 11 in that orifices corresponding to orifice 220 direct coolant into tube 322 and from tube 324. In addition, a tube 326 serves as a separator tube for delivering inlet coolant from header 306 to header 308, and it has an orifice (not shown) for receiving coolant for separator tube 326 under high pressure from a part of header 306 as discussed below. Similarly, a tube 327 which is the return separator tube for carrying coolant from header 308, also has an orifice 328 in header 306.

For space limitations or assembly considerations, sometimes (as noted above) it is necessary to remove the inner wall or a section of the inner tube instead of one or the other of the orifices. Other times, a separator plate is used and the standard angle interior tubes are used instead of separator tubes.

Keel cooler 300 has one set of coolant flow tubes 302 for carrying hot coolant from header 306 to header 308, where the direction of coolant flow is turned 180° by header 308, and the coolant enters a second set of tubes 304 for returning the partially cooled coolant back to header 306. Thus, coolant under high pressure flows through tubes 302 from header 306 to header 308, and the coolant then returns through tubes 304, and subsequently through nozzle 312 to the engine or other heat source of the vessel. Walls 334 and 336 (shown in FIG. 15) of tubes 326 and 327 in header 306 are solid, and act as separators to prevent the mixing of the hot coolant going into coolant flow tubes 302, and the cooled coolant flowing from tubes 304. There is a fairly uniform rate of flow through the tubes in both directions. Such efficient systems have been unable to be produced under the prior art, since the pressure drop across all six (or as many as would be realistically considered) orifices made the prior keel coolers too inefficient due to poor coolant distribution to be operated without a substantial additional safety factor. That is, in order to have two-pass systems, prior one piece keel cooler systems having two-pass arrangements are up to 20% larger than those required pursuant to the present invention to provide sufficient heat exchange surfaces to remove the required amount of heat from the coolant while attempting to maintain acceptable pressure drops.

The multiple-pass heat exchanger system shown in FIGS. 14 and 15 can be described as explained below. Thus, FIGS. 14 and 15 show a one-piece multiple-pass heat exchanger 300 comprising a first set of parallel coolant/heating flow tubes 302 extending in a longitudinal direction for carrying coolant fluid medium from a heat source in one direction for transferring heat from the coolant fluid cooling medium (the heat exchanger could also be used for a heating function). The first set of coolant/heating flow tubes 302 has a first outermost side tube 322 and a first separator tube 326, the first separator tube 326 having a pair of parallel opposing side walls with a first solid outer side wall 334 and a first inner side wall 335. The first solid outer side wall 334 has an interior surface facing the interior of the first inner side wall 335, and the first inner side wall 335 has an exterior surface being parallel to and facing the first outermost side tube 322. The first separator tube 326 has a first end portion with an opening 337 in the first inner side wall 335 in the first end portion of the first separator tube 326 to give access to the interior of first separator tube 326. The first outermost side tube 322 has a first solid outer side wall 338 and a first inner side wall 339, the latter first solid outer side wall 338 having an interior surface facing the interior of the latter first inner side wall 339. The latter first inner side wall 339 is parallel to and has an exterior surface facing the first separator tube 326. The first outermost side tube 322 has a first end portion with an opening 340 in the latter first inner side wall 339 in the latter first end portion giving access to the interior of the first outermost side tube 322 and an opposite second end portion with an opening 341 in the latter first inner side wall 339 in the latter second end portion giving access to the interior of the first outermost tube side tube 322. There are from none to a number of first inner tubes 330 located between the first outermost side tube 322 and the first separator tube 326. First inner tubes 330 have first open ports 342 proximate other first open ports of first inner tubes 330 for receiving coolant fluid from the heat source and opposite second open ports 343 proximate other second open ports of other first inner tubes 330 for discharging coolant fluid from the first inner tubes 330. A second open port 344 of the first separator tube 326 is proximate to the second open ports 343 of the first inner tubes 330.

FIGS. 14 and 15 further show a second set of parallel coolant/heating flow tubes 304 being rectangular in cross section and extending in a longitudinal direction parallel to the first set of coolant/heating flow tubes 330 for carrying coolant fluid coolant medium discharged by the first set of cooling/heating flow tubes 330 in a second direction opposite to the first direction for transferring heat from the coolant fluid cooling medium. The second set of coolant/heating flow tubes 304 has a second outermost side tube 324, a second separator tube 327 having a pair of parallel opposing side walls 336, 345 with a second solid outer side wall 336 and a second inner side wall 345. The second solid outer side wall 336 has an interior surface wall facing the interior of the second inner side wall 345. The second inner side wall 345 has an exterior surface which is parallel to and facing the second outermost side tube 324, the second separator tube 327 having a first end portion with an opening 328 in the second inner side wall in the first end portion of the second separator tube 327 giving access to the interior of the second separator tube 327. The second outermost side tube 324 has a second solid outer side wall 346 and a second inner side wall 347, said latter second solid outer side wall 346 having an interior surface facing the interior of the latter second inner side wall 347. The latter second inner side wall 347 is parallel to and having an exterior surface facing the second separator tube 327. The second outermost side tube 324 further has a first end portion with an opening 348 in the latter second inner side wall in said latter first end portion giving access to the interior of said second outermost side tube 324, and an opposite second end portion with an opening 349 in the latter second inner side wall in the latter second end portion giving access to the interior of the second outermost side tube 324. There are from none to a number of second inner tubes 332 located between the second outermost side tube 324 and the second separator tube 327, the second inner tubes 332 having first open ports 350 proximate other first open ports 350 of the second inner tubes 332. The first open ports 350 of the second inner tubes 332 are adjacent to the second open ports 343 of said first inner tubes 330 for receiving coolant fluid discharged by the second open ports 343 of said first inner tubes 330. The second inner tubes 332 further have second open ports 351 proximate other second open ports 351 of other second inner tubes 332 for discharging coolant fluid from the second inner tubes 332. The second open ports 351 of said second inner tubes 332 are adjacent to the first open ports 342 of the first inner tubes 330, and the second separator tube 327 have a second open port 352 proximate the second open ports 343 of the first inner tubes 330 and the first open ports 350 of the second inner tubes 332.

A fluid conduit holding header 306 is connected to the first set of coolant/heating flow tubes 330 and to the second set of coolant/heating flow tubes 332 at the first end portion of the first separator tube 326, at the first end portion of the first outermost side tube 322, at said first open ports of the first inner tubes 330, at the second end portion of the second separator tube 327, at the second end portion of said second outermost side tube 324, and at the second open ports of the second inner tubes 332. The fluid conduit holding header 306 is divided by the first solid outer side wall 334 of the first separator tube 326 and the second solid outer side wall 336 of the second separator tube 327. The fluid conduit holding header 306 comprises a first inner surface 359 including the first open ports 342 of the first inner tubes 330 and the second open ports 351 of the second inner tubes 332, the first solid outer side wall 334 and the second solid outer side wall 336 prevent the mixing of hot coolant fluid flowing into both the first open ports 342 of the first inner tubes 330 and the openings 340, 337 in the first outermost side tube 322 and the first separator 326 with the cooled coolant fluid being discharged by the second open ports 351 of the second inner tubes 332 and the openings 348, 328 in the second outermost side tube 324 and the second separator tube 327. Also included in the fluid conduit holding header is an upper wall 316 having an upper end portion 353, opposing side portions 354, 355 and an upper inner portion 356. There are first and second inlet/outlet openings 357, 358 on opposite sides of the first and second separator tubes 326, 327 with openings 357 having access respectively to the first open ports 342 of said first inner tubes 330 and the openings 340, 337 to the first outermost side tube 322 and said first separator tube 326k for permitting the flow of coolant along projected flow paths determined by a projection of the respective openings 342, 351 into fluid conduit holding header 306, between each of the inlet/outlet openings 357, 358 and the fluid conduit holding header 306. The upper wall 316 has a length extending between upper end portion 353 and the upper inner portion 356.

Also included in the fluid conduit holding header 306 is a lower wall 360 having a length less than the length of the upper wall 316 and being disposed inwardly of both the upper end portion 353 and the upper inner portion 356 of upper wall 316. Fluid conduit holding header side walls 361, 362 (forming part of the solid outermost walls of the first and second pair of outermost walls 322, 324) interconnect the side portions 356 of said upper wall 316 and lower wall 360.

A closed end portion 363 opposite the inner surface is also part of the fluid conduit holding header 306. The closed end portion 363 has an end wall 364 extending generally perpendicularly from the upper end portion 353 of the upper wall 316. The closed end portion has a height, and a beveled wall 365 beveled from the end wall 364 and extending away from the upper wall 316 and intersecting lower wall 360. The beveled wall 365 terminates in the projected flow path for reducing turbulence and pressure drop of coolant flow to and/or from the first and second sets of coolant/heating flow tubes 330, 332 and for increasing ambient fluid flow to the exterior surfaces of the first and second sets of coolant/heating flow tubes 330, 332 compared to a non-beveled wall. The beveled wall 365 has a length substantially greater than the height of the end wall 364 and extending between and intersecting the side portions 354, 355 of the fluid conduit holding header and the ends of the first and second separator tubes 326, 327.

Multiple-pass heat exchanger 300 further is composed of a closed header 308 connected to the first set of coolant/heating flow tubes 330 and to the second set of coolant/heating flow tubes 332 at the second end portion of the first pair of outermost tubes 322, 326, at the second ports 343 of the first inner tubes 330, at the first end portion of the second pair of outermost tubes 324, 327, and at the first open ports 350 of the second inner tubes 332.

The closed header 308 comprises a second inner surface 370 including the second open ports 343 of the first inner tubes 330 and the first open ports 350 of the second inner tubes 332. An upper wall 371 has an upper end portion 372, opposing side portions 373, 374 and an upper inner portion 375. The upper wall 371 has a length extending between its upper end portion 372 and its upper inner portion 375. Also comprising the closed header 308 are a lower wall 376 having a length less than the length of upper wall 371 and being disposed inwardly of the upper end portion 372 and the upper inner portion 375 of upper wall 371. Closed header side walls 377, 378 interconnect the side portions 373, 374 of upper wall 371 and lower wall 376. The closed header side walls 377, 378 comprise the end portions of first solid outer walls of the first and second outermost side tubes 322, 324. A closed end portion 379 is opposite said latter inner surface 370. The closed end portion 379 has an end wall 380 extending generally perpendicularly from the upper end portion 372 of the latter upper wall 371. The end wall 380 has a height and a beveled wall 381 beveled from the latter end wall 380 and extending away from said the upper wall 380 and intersecting said the lower wall 376. The beveled wall 381 reduces turbulence and pressure drop of coolant flow to and/or from the first and second sets of coolant/heating flow tubes 330, 332 and increases ambient fluid flow to the exterior surfaces of first and second sets of coolant/heating flow tubes 330, 332 compared to a non-beveled wall. The beveled wall 381 has a length substantially greater than the height of the end wall 380 and extends between and intersects said side portions 373, 374 of the closed header and the ends of said first and second separator tubes.

The embodiment shown in FIGS. 14 and 15 can also be described as follows: A one-piece multiple-pass heat exchanger 300 has opposing headers 308, 306 with forwardly and rearwardly facing beveled end walls 315, 321, one of opposing headers 306 having fluid conduits 310, 312 for delivering and removing coolant from header 306 and the other 308 of the opposing headers being closed and not transferring coolant. The heat exchanger 300 comprises first and second one-piece heat exchanger components positioned side-by-side. Each heat exchanger component includes a separator coolant flow tube 326, 327 extending between beveled end walls 315, 321 of opposing headers 306, 308. The separator coolant flow tubes 326, 327 have interior tube walls 335, 345 with an orifice between the separator tubes 326, 327 and two chambers of headers 306 for enabling the flow of coolant between separator coolant flow tubes 326, 327 and header 306. A solid interior separator wall at header 306 between fluid conduits 310, 312 prevents the flow of coolant between the respective heat exchanger components. The multiple-pass heat exchanger 300 further comprises outermost coolant flow tubes 322, 324 extending between beveled end walls 315, 321 of opposing headers 306, 308. The outermost coolant flow tubes 322, 324 have interior tube walls 339, 347 with orifices 340, 348, 341, 349 between the outermost coolant flow tubes 322, 324 and respective ones 306, 308 of the opposing headers for enabling the flow of coolant between outermost coolant flow tubes 322, 324 and the respective opposing headers 306, 308 and a solid exterior wall for contributing to maintaining coolant in said heat exchanger component.

The keel cooler system shown in FIG. 14 has 8 flow tubes. However, the two-pass system would be appropriate for any even number of tubes, especially for those above two tubes. There are presently keel coolers having as many as 24 tubes, but it is possible according to the present invention for the number of tubes to be increased even further. These can also be keel coolers with more than two passes. If the number of passes is even, both nozzles are located in the same header. If the number of passes is an odd number, there is one nozzle located in each header.

Figure 16:
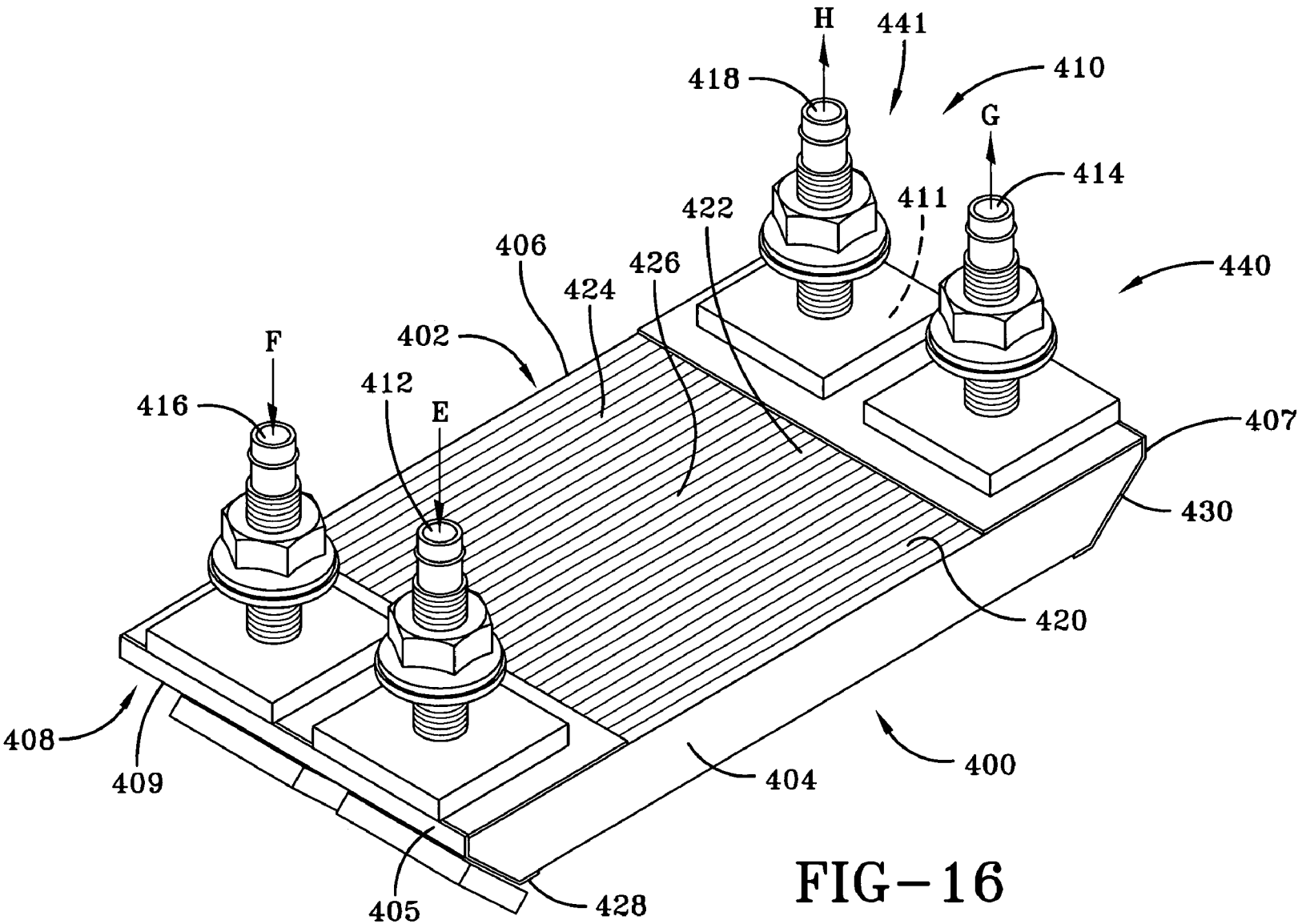
FIG. 16 is a pictorial view of a multiple system combined, having two single-pass portions, according to the invention.

Another aspect of the present invention is shown in FIG. 16, which shows a multiple systems combined keel cooler which has heretofore not been practically possible with one-piece keel coolers. Multiple systems combined can be used for cooling two or more heat sources, such as two relatively small engines or an aftercooler and a gear box in a single vessel. Although the embodiment shown in FIG. 16 shows two keel cooler systems, there could be additional ones as well, depending on the situation. As explained below, the present invention allows multiple systems to be far more efficient than they could have been in the past. Thus, FIG. 16 shows a multiple systems keel cooler 400. Keel cooler 400 has a set of heat conducting or coolant flow tubes 402 having outermost tubes 404 and 406, which have orifices at their respective inner walls which are similar in size and position to those shown in the previously described embodiments of the invention. For two single-pass, multiple systems combined, keel cooler 400 has identical headers 408 and 410, having inlet nozzles 412, 416 respectively, and outlet nozzles 414, 418 respectively. Both nozzles in respective headers 408 and 410 could be reversed with respect to the direction of flow in them, or one could be an inlet and the other could be an outlet nozzle for the respective headers. Arrows E, F, G and H show the direction of the coolant flow through the nozzles respectively. A set of tubes 420 for conducting coolant between nozzles 412 and 418 commence with outermost tube 404 and terminate with separator tube 422, and a set of tubes 424 extending between nozzles 414 and 416, commencing with outermost tube 406 and terminating with separator tube 426. The walls of tubes 422 and 426 which are adjacent to each other are solid, and extend between the end walls of headers 408 and 410. These walls thus form system separators, which prevent the flow of coolant across these walls, so that the tubes 420 form, in effect, one keel cooler, and tubes 424 form, in effect, a second keel cooler (along with their respective headers). Keel cooler 400 has beveled closed end portions 428, 430 as discussed earlier. Header 408 has a beveled end wall 409, and header 410 has a beveled end wall 411, all having the advantages with respect to internal coolant flow and ambient flow as discussed above. This type of keel cooler can be more economical than having two separate keel coolers, since there is a savings by only requiring two headers, rather than four. Multiple keel coolers can be combined in various combinations. There can be two or more one-pass systems as shown in FIG. 16.

The multiple systems combined heat exchanger system can also be described as follows: Multiple systems combined heat exchanger system 400 has opposing headers with forwardly and rearwardly facing beveled end walls 409, 411. Multiple systems combined heat exchanger 408 comprises a first heat exchanger 440. The first heat exchanger 440 is composed of a first outermost exterior coolant flow tube 404 extending between said beveled walls 409, 411 and end walls 405, 407 of said opposing header 408, 410 and has a solid outer wall and an inner wall with an orifice to each of a respective one of said opposing headers 408, 410 for enabling the flow of coolant between said first outennost tube 404 and said respective opposing headers. The first heat exchanger 440 further contains a first separator coolant flow tube 422 extending between beveled walls and end walls 409, 411 of opposing headers 408, 410. The first separator coolant flow tube 422 has an interior tube wall with an orifice between each end portion of said first separator coolant flow tube 422 and the respective ones of the opposing headers 408, 410 for enabling the flow of coolant between tube 422 and the respective opposing headers 408, 410.

The second heat exchanger 441 includes a second outermost coolant flow tube 406 extending between beveled walls 409, 411 and end walls 405, 407 of opposing headers 408, 410, and having a solid outer wall and an interior wall with an orifice between each end portion to a respective one of opposing headers 408, 410 for enabling the flow of coolant between the first outermost flow tube 406 and respective opposing headers 408, 410. The second heat exchanger 441 further includes a second separator coolant flow tube 426 extending between beveled walls 409, 411 and end walls 405, 407 of opposing headers 408, 410. The second separator coolant flow tube 426 has an interior tube wall with an orifice between second separator coolant flow tube 426 and the respective ones of opposing headers 408, 410 for enabling the flow of coolant between said separator flow tube 426 and the respective opposing headers 408, 410. At least one of the first and second separator tubes has a separator wall extending across each of said opposing headers 408, 410 for separating first and second heat exchangers 440, 441 to prevent the flow of coolant from either of said heat exchangers to the other of said heat exchangers. Although two separator tubes are shown in FIG. 16, various arrangements—including a single separator wall—can be used.

Figure 17:
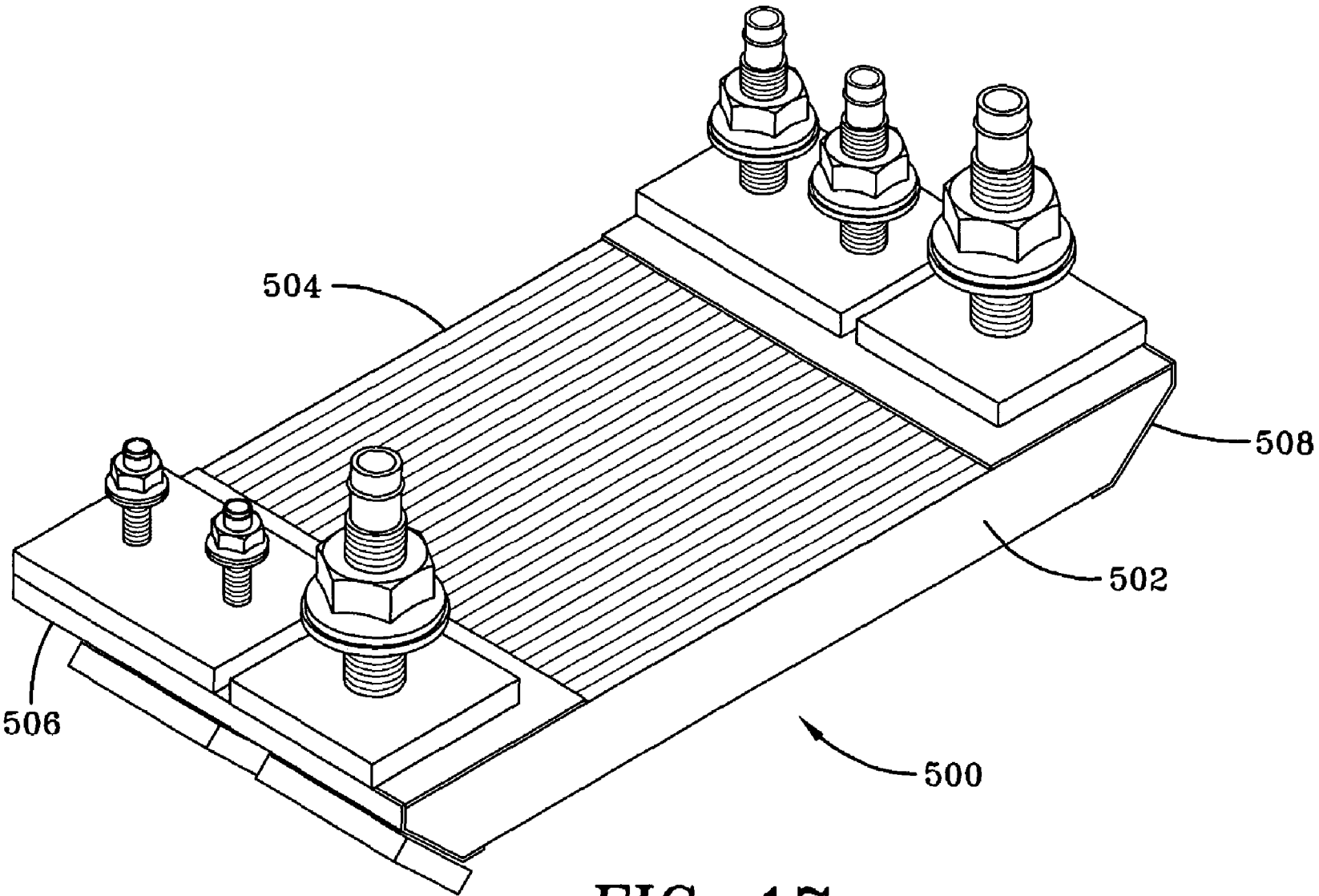
FIG. 17 is a pictorial view of a keel cooler according to the invention, having a single-pass portion and a double-pass portion.

There can be one or more single-pass systems and one or more double-pass systems in combination as shown in FIG. 17. In FIG. 17, a keel cooler 500 is depicted having a single-pass keel cooler portion 502, and a double-pass keel cooler portion 504. Keel cooler portion 502 functions as that described with reference to FIGS. 6-11, and keel cooler portion 504 functions as that described with reference to FIGS. 14 and 15. FIG. 17 shows a double-pass system for one heat exchanger, and additional double-pass systems could be added as well. Keel cooler 500 has beveled end walls 506, 508, with the advantages over the prior art with respect to internal coolant flow and external ambient liquid flow as discussed above.

Figure 18:
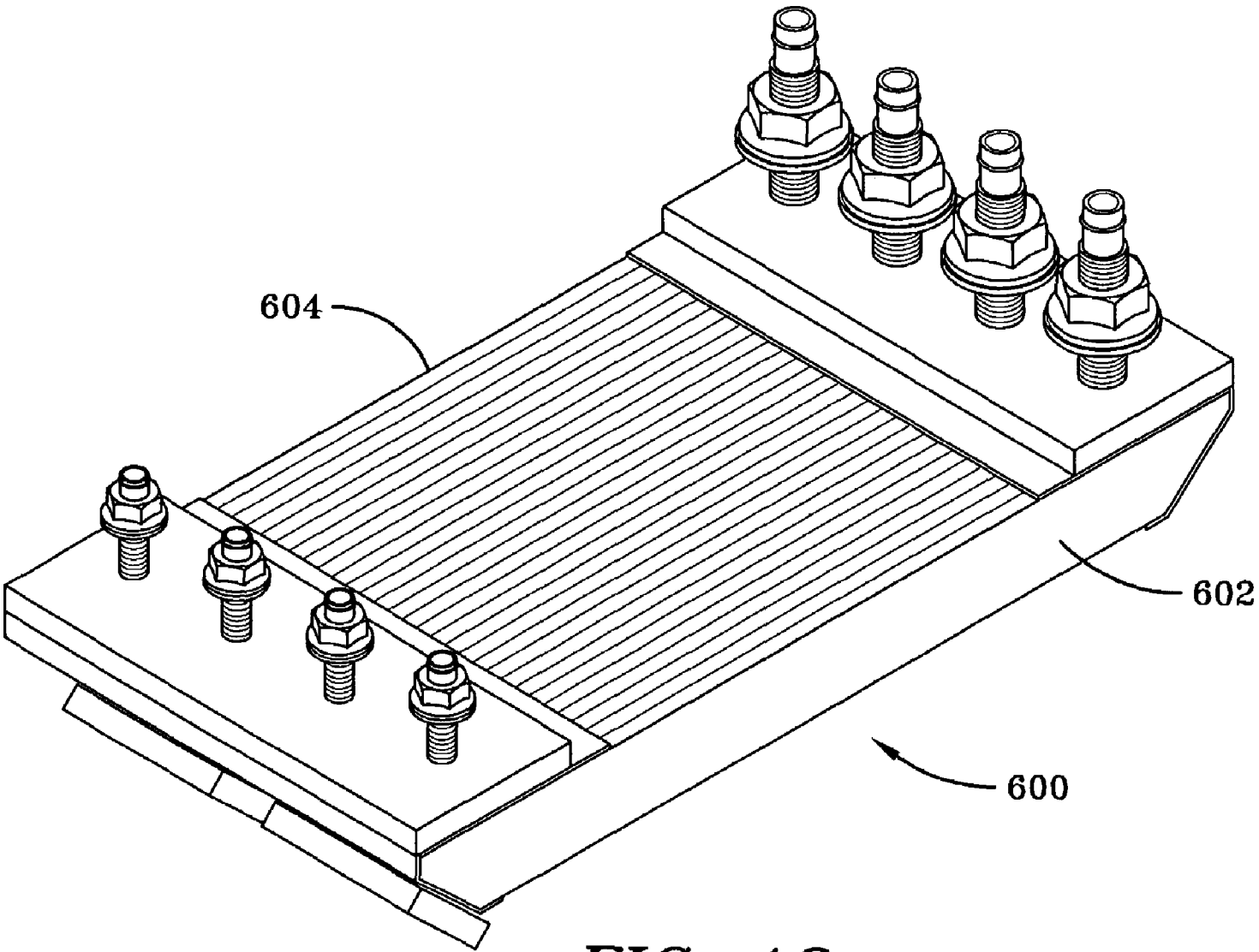
FIG. 18 is a pictorial view of two double-pass systems according to the invention.

FIG. 18, shows a keel cooler 600 having 2 double-pass keel cooler portions 602, 604, which can be identical or have different capacities. They each function as described above with respect to FIGS. 14 and 15, and have beveled end walls as discussed earlier. Multiple coolers combined are a powerful feature not found in prior one-piece keel coolers. The modification of the special separator/tube design improves heat transfer and flow distribution while minimizing pressure drop concerns.

The keel coolers described above show nozzles for transferring heat transfer fluid into or out of the keel cooler. However, there are other means for transferring fluid into or out of the keel cooler; for example, in flange mounted keel coolers, there are one or more conduits such as pipes extending from the hull and from the keel cooler having end flanges for connection together to establish a heat transfer fluid flow path. Normally a gasket is interposed between the flanges. There may be other means for connecting the keel cooler to the coolant plumbing system in the vessel. This invention is independent of the type of connection used to join the keel cooler to the coolant plumbing system.

Figure 13:
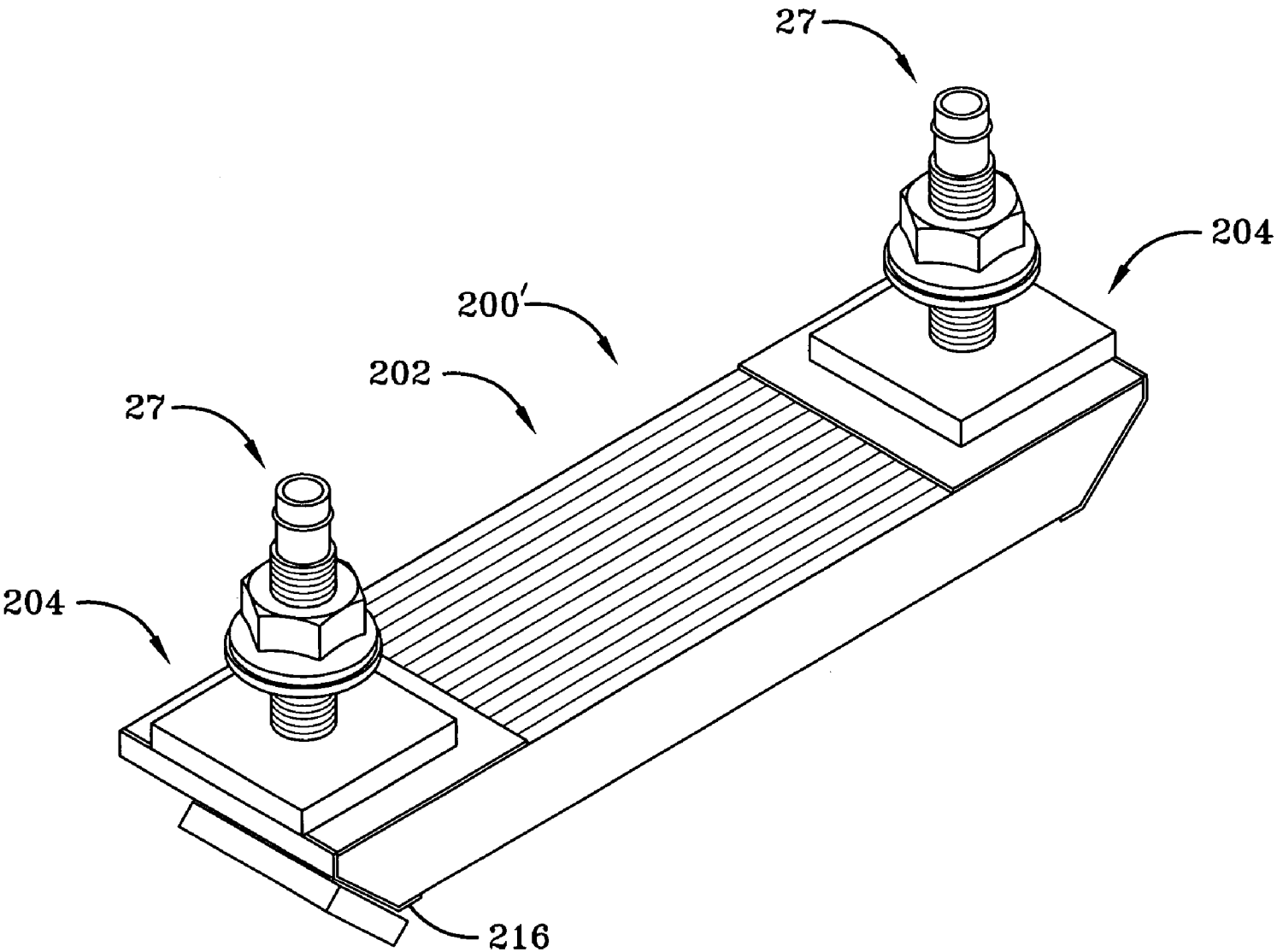
FIG. 13 is a pictorial view of a keel cooler according to the invention.

Keel coolers according to the invention are used as they have been in the prior art, and incorporate two headers which are connected by an array of parallel coolant flow tubes. A common keel cooler according to the invention is shown in FIG. 13, which illustrates a keel cooler 200' having opposing headers 204 like the one shown in FIG. 7. The headers shown have the identical numbers to those shown in FIG. 7. Heated coolant fluid flows into one nozzle 27 from a heat source in the vessel, then flows through one header 204, the coolant flow tubes 202, the other header 204, the other nozzle 27, and the cooled coolant flows back to the heat source in the vessel. While flowing through headers 204 and coolant flow tubes 202, the coolant transfers heat to the ambient water. All of the advantages of the beveled wall 216 apply to keel cooler 200'.

The keel coolers described above show nozzles for transferring heat transfer fluid into or out of the headers. However, there are other means for transferring fluid into or out of the headers; for example, in flange mounted keel coolers, there are one or more conduits such as pipes extending from the hull and from the keel cooler having end flanges for connection together to establish a heat transfer fluid flow path. Normally a gasket is interposed between the flanges. There may be other means for connecting the keel cooler to the coolant plumbing system in the vessel. This invention is independent of the type of connection used to join the keel cooler to the coolant plumbing system.

The invention has been described with particular reference to the preferred embodiments thereof, but it should be understood that variations and modifications within the spirit and scope of the invention may occur to those skilled in the art to which the invention pertains.

What is claimed is:

1. A one-piece multiple-pass heat exchanger comprising:

a first set of parallel coolant/heating flow tubes extending in a longitudinal direction for carrying coolant fluid cooling medium from a heat source in one direction for transferring heat from the coolant fluid cooling medium, said first set of coolant/heating flow tubes having a first outermost side tube and a first separator tube, said first separator tube having a pair of parallel opposing side walls with a first solid outer side wall and a first inner side wall, said first solid outer side wall having an interior surface facing the interior of said first inner side wall, said first inner side wall having an exterior surface being parallel to and facing said first outermost side tube, said first separator tube having a first end portion with an opening in said first inner side wall in said first end portion giving access to the interior of said first separator tube, said first outermost side tube having a first solid outer side wall and a first inner side wall, said latter first solid outer side wall having an interior surface facing the interior of said latter first inner side wall, said latter first inner side wall being parallel to and having an interior surface facing said first separator tube, said first outermost side tube having a first end portion with an opening in said latter first inner side wall in said latter first end portion giving access to the interior of said first outermost side tube and an opposite second end portion with an opening in said latter first inner side wall in said latter second end portion giving access to the interior of said first outermost side tube, and from none to a number of first inner tubes located between said first outermost side tube and said first separator tube, said first inner tubes having first open ports proximate other first open ports of said first inner tubes for receiving coolant fluid from the heat source and opposite second open ports proximate other second open ports of other first inner tubes for discharging coolant fluid from said first inner tubes; said first separator tube having a second open port proximate to said second open ports of said first inner tubes;

a second set of parallel coolant/heating flow tubes extending in a longitudinal direction parallel to said first set of coolant/heating flow tubes for carrying coolant fluid cooling medium discharged by said first set of cooling/heating flow tubes in a second direction opposite to said first direction for transferring heat from the coolant fluid cooling medium, said second set of coolant/heating flow tubes having a second outermost side tube and a second separator tube, said second separator tube having a pair of parallel opposing side walls with a second solid outer side wall and a second inner side wall, said second solid outer side wall having an interior surface wall facing the interior of said second inner side wall, said second inner side wall having an exterior surface being parallel to and facing said second outermost side tube, said second separator tube having a first end portion with an opening in said second inner side wall in said first end portion of said second separator tube giving access to the interior of said second separator tube, said second outermost side tube having a second solid outer side wall and a second inner side wall, said latter second solid outer side wall having an interior surface facing the interior of said latter second inner side wall, said latter second inner side wall being parallel to and having an exterior surface facing said second separator tube, said second outermost side tube having a first end portion with an opening in said latter second inner side wall in said latter first end portion giving access to the interior of said second outermost side tube, and an opposite second end portion with an opening in said latter second inner side wall in said latter second end portion giving access to the interior of said second outermost side tube, and from none to a number of second inner tubes located between said second outermost side tube and said second separator tube, said second inner tubes having first open ports proximate other first open ports of said second inner tubes, said first open ports of said second inner tubes being adjacent to said second open ports of said first inner tubes, for receiving coolant fluid discharged by said second open ports of said first inner tubes, said second inner tubes further having second open ports proximate other second open ports of other second inner tubes for discharging coolant fluid from said second inner tubes, said second separator tube having a second open port proximate to said second open ports of said first inner tubes and to said first open ports of said second inner tubes;

a flow conduit holding header connected to said first outermost side tube, to said first inner tubes, to said first end portion of said first separator tube, to said second end portion of said second separator tube, to said second open ports of said second inner tubes, and to said second outermost side tube, said flow conduit holding header being divided by said first solid outer side wall of said first separator tube and said second solid outer side wall of said second separator tube; said flow conduit holding header comprising:

a first inner surface including said first open ports of said first inner tubes and said second open ports of said second inner tubes, said first solid outer side wall and said second solid outer side wall of said first and second separator tube, respectively, for preventing the mixing of hot coolant fluid flowing into both said first open ports of said first inner tubes, said openings in said first portion of said first outermost side tubes and said opening in said first separator tube, with the cooled coolant fluid being discharged by said second open ports, of said second inner tubes, said opening of said second separator tube and said opening in said second portion of said second outermost side tube;

a first upper wall having a first upper end portion, opposing first side portions and a first upper inner portion, and first and second inlet/outlet openings on opposite sides of said first and second separator tubes with access respectively to said first open ends of said first inner tubes and said openings to said first outermost side tube and said first separator tube, for permitting the flow of coolant along projected flow paths determined by a projection of said respective openings into said flow conduit holding header, between each of said inlet/outlet openings and said flow conduit holding header, said first upper wall having a length extending between said first upper end portion and said first upper inner portion;

a first lower wall opposite to said first upper wall, and having a length less than the length of said first upper wall and being disposed inwardly of both the first upper end portion and the first upper inner portion of said first upper wall;

flow conduit holding header side walls interconnecting said side portions of said first upper wall and said first lower wall, said flow conduit holding header side walls comprising the end portions of said first solid outer walls of said first and second outermost side tubes; and a first closed end portion opposite said first inclined inner surface, said closed end portion having a first end wall extending generally perpendicularly from the first upper end portion of said first upper wall, said first end wall having a height, and a first beveled wall beveled from said first end wall and extending from said first end wall and intersecting said first lower wall, said first beveled wall terminating in said projected flow path, for reducing turbulence and pressure drop of coolant flow to and/or from said first and second sets of coolant/heating flow tubes and for increasing ambient fluid flow to the exterior surfaces of said first and second sets of outermost side and separator coolant/heating flow tubes compared to a non-beveled wall, said first beveled wall having a length substantially greater than the height of said first end wall and extending between and intersecting said side portions of said fluid conduit holding header; and a closed header connected to said first set of coolant/heating flow tubes and to said second set of coolant/heating flow tubes at said second end portion of said first and second outermost side tubes, at said second ports of said first inner tubes, at said first end portion of said separator tubes, and at said first open ports of said second inner tubes, said closed header comprising:

a second inclined inner surface including said second open ports of said first inner tubes and said first open ports of said second inner tubes;

a second upper wall having a second upper end portion, opposing second side portions and an upper inner portion, said second upper wall having a length extending between said second upper end portion and said second upper inner portion;

a second lower wall having a length less than the length of said second upper wall and being disposed inwardly of the second upper end portion and the second upper inner portion of said second upper wall;

closed header side walls interconnecting said second side portions of said second upper wall and said second lower wall, said closed header side walls comprising the end portions of said second first solid outer walls of said first and second outermost side tubes; and a second closed end portion opposite said second inclined inner surface, said second closed end portion having a second end wall extending generally perpendicularly from the upper end of said second upper wall, said second end wall having a height, and a second beveled wall beveled from said second end wall and extendihg away from said second upper wall and intersecting said second lower wall, said second beveled wall reducing turbulence and pressure drop of coolant flow to and/or from said first and second sets of coolant/heating flow tubes and for increasing ambient fluid flow to the exterior surfaces of said first and second sets of coolant/heating flow tubes compared to a non-beveled wall, said second beveled wall having a length substantially greater than the height of said second end wall and extending between and intersecting said side portions of said closed header and the ends of said first and second separator tubes.

2. A heat exchanger according to claim 1 wherein the amount of bevel of said first and second beveled walls is at an exterior angle θ measured from the plane of said respective first and end walls, angle θ being no less than 20° and no greater than 70°.

3. A heat exchanger according to claim 1 wherein said first lower wall is parallel to said first upper wall and forms a juncture between said first inclined inner surface and said first beveled wall.

4. A heat exchanger according to claim 3 wherein said first lower wall extends across the general middle of the projection of said inlet/outlet opening, and said first beveled wall joins said first lower wall along a line extending through said projection near the middle of said projection.

5. A one-piece heat exchanger according to claim 1 wherein said coolant/heating flow tubes are parallel in cross section.

6. A one-piece heat exchanger according to claim 1 wherein said fluid conduit holding header is a nozzle holding header.

7. A one-piece heat exchanger according to claim 1 wherein said first and second inner surfaces include respective first and second open ports are each inclined.

8. A one-piece heat exchanger according to claim 1 wherein each of said upper walls and lower walls is flat, wherein each of said upper end portions is flat, wherein each of said end walls is flat, wherein each of said beveled walls is flat, and wherein said flat upper end portion and said flat inner portion of each flat upper wall lie in a plane.

9. A heat exchanger according to claim 1 wherein said second lower wall is parallel to said second upper wall and forms a juncture between said second inclined inner surface and said second beveled wall.

10. A one-piece multiple-pass heat exchanger having opposing headers with forwardly and rearwardly facing beveled end walls, one of said opposing headers being a fluid conduit holding header having nozzles for delivering and removing coolant from said one header and the other of said opposing headers being a closed header and not transferring coolant through nozzles, said heat exchanger comprising:

first and second one-piece heat exchanger components positioned side-by-side, each heat exchanger component comprising:

an inner separator coolant flow tube extending between said beveled end walls of said opposing headers, said inner separator coolant flow tube having an interior tube wall with an orifice between said inner separator coolant flow tube and said fluid conduit holding header for enabling the flow of coolant between said inner separator coolant flow tube and said fluid conduit holding header, and a solid interior separator wall at said fluid conduit holding header for preventing the flow of coolant between said respective heat exchanger components at said fluid conduit holding header; and an outermost side coolant flow tube extending between said beveled end walls and said opposing headers, said outermost side coolant flow tube having an interior tube wall with an orifice between said outermost side coolant flow tube and the respective ones of said opposing headers for enabling the flow of coolant between said outermost side coolant flow tubes and said respective opposing headers, and a solid exterior wall for contributing to maintaining coolant in said heat exchanger component.

11. A multiple systems combined heat exchanger system having opposing headers with forwardly and rearwardly facing beveled walls and end walls, said multiple systems combined heat exchanger comprising:

a first heat exchanger including:

a first outermost side coolant flow tube extending between said beveled walls and said end walls of said opposing headers, and having a solid outer wall and an interior wall with an orifice to each of a respective one of said opposing headers for enabling the flow of coolant between said first outermost side flow tube and said respective opposing headers;

a first separator coolant flow tube extending between said beveled walls and said end walls of said opposing headers, said first separator coolant flow tube having an interior tube wall with an orifice between each end portion of said first separator coolant flow tube and said respective ones of said opposing headers for enabling the flow of coolant between said first separator coolant flow tube and said respective opposing headers;

a second heat exchanger including:

a second outermost side coolant flow tube extending between said beveled walls and said end walls of said opposing headers, and having a solid outer wall and an interior wall with an orifice between each end portion to a respective one of said opposing headers for enabling the flow of coolant between said first outermost side flow tube and said respective opposing headers; and a second separator coolant flow tube extending between said beveled walls and end walls of said opposing headers, said second separator coolant flow tube having an interior tube wall with an orifice between each end portion of said second separator coolant flow tube and said respective ones of said opposing headers for enabling the flow of coolant between said second separator coolant flow tube and said respective opposing headers;

wherein at least one of said separator tubes includes a solid separator wall extending across each of said opposing headers for separating said first and second heat exchangers to prevent the flow of coolant from either of said heat exchangers to the other of said first and second heat exchangers.

12. A multiple systems combined heat exchanger according to claim 11 wherein at least one of said first heat exchanger and said second heat exchanger is a single-pass heat exchanger.

13. A multiple systems combined heat exchanger according to claim 11 wherein at least one of said first heat exchanger and said second heat exchanger is a double-pass heat exchanger.

14. A multiple systems combined heat exchanger according to claim 11 wherein at least one of said first heat exchanger and said second heat exchanger is a multiple-pass heat exchanger.

15. A one-piece heat exchanger for use with at least one heat source and having a forward portion and rearward portion, said heat exchanger comprising:

a forwardly disposed first header including:

a forwardly facing beveled end wall; and at least one chamber for receiving coolant fluid and having a forward end defined at least in part by said forwardly facing beveled end wall;

a rearwardly-disposed second header including:

a rearwardly facing beveled end wall; and at least one chamber for receiving coolant fluid and having a rearward end defined at least in part by said rearwardly facing beveled end wall;

at least one input flow conduit in at least one of said headers for transferring coolant fluid from the at least one heat source to said at least one header;

at least one outlet flow conduit in at least one of said headers for transferring coolant fluid from said at least one header to the at least one heat source;

coolant/heating flow tubes, rectangular in cross-section with identical rectangular dimensions including rectangular openings extending between said first and second headers for transferring coolant flow between said first and second headers, wherein said openings to said flow tubes are beneath said at least one input flow conduit and said at least one output flow conduit, wherein an outermost side coolant flow tube extending between said respective beveled end walls and said opposing headers has a solid exterior wall also defining a side wall of said one-piece heat exchanger and wherein an innermost coolant flow tube extending between said respective beveled end walls and said opposing headers defines a partition between said at least one input flow conduit and said at least one output flow conduit, said innermost coolant flow tube including an orifice on an inner side wall to give access to said coolant flow into said innermost coolant flow tube;

structure in said coolant flow tubes and in at least one of said first and second headers for establishing separate coolant flow paths in the coolant flow tubes, said structure being selected from the group consisting of multiple-pass structure and multiple systems combined structure.

16. A heat exchanger according to claim 15, wherein said outermost side tube has a first end portion with an opening in an inner side wall in said first end portion giving access to the interior of the at least one outermost side tube.

* * * * *